US012799700B2

(12) United States Patent
Crippa et al.

(10) Patent No.: US 12,799,700 B2
(45) Date of Patent: Nov. 17, 2026

(54) ROLL

(71) Applicant: TENAX S.p.A., Vigano' (IT)

(72) Inventors: Alberto Crippa, Baltimore, MD (US); Cesare Beretta, Engelberg (CH)

(73) Assignee: TENAX S.p.A., Vigano' (IT)

( * ) Notice: Subject to any disclaimer, the term of this patent is extended or adjusted under 35 U.S.C. 154(b) by 196 days.

(21) Appl. No.: 18/758,621

(22) Filed: Jun. 28, 2024

(65) Prior Publication Data

US 2025/0012033 A1 Jan. 9, 2025

(30) Foreign Application Priority Data

Jul. 4, 2023 (IT) ..... 102023000013959

(51) Int. Cl.
*E02D 17/20* (2006.01)
*E01C 21/00* (2006.01)

(52) U.S. Cl.
CPC ..... *E02D 17/20* (2013.01); *E01C 21/00* (2013.01); *E02D 2200/13* (2013.01)

(58) Field of Classification Search
CPC ..... E02D 17/20; E02D 17/202; E01C 21/00; A01G 13/32; E02B 3/122
See application file for complete search history.

(56) References Cited

U.S. PATENT DOCUMENTS 3,386,876 A 6/1968 Wyckoff
4,662,946 A 5/1987 Mercer et al.
5,419,659 A 5/1995 Mercer
5,753,337 A 5/1998 Slocumb
6,423,394 B1 7/2002 Mercer et al.
7,407,699 B2 8/2008 Jacoby
2003/0145778 A1 8/2003 Judge
2004/0062615 A1 4/2004 Walsh
2004/0213637 A1 * 10/2004 Ianniello ..... B09B 1/00 405/302.6

(Continued)

FOREIGN PATENT DOCUMENTS

EP 0985616 A2 3/2000
WO 2020252233 A1 12/2020

OTHER PUBLICATIONS

Italian Search Report for IT 202300013959, dated Jan. 30, 2024, 6 pages.

*Primary Examiner* — Amber R Anderson
*Assistant Examiner* — Stacy N Lawson
(74) *Attorney, Agent, or Firm* — Nixon & Vanderhye P.C.

(57) ABSTRACT

A roll (1) for soil consolidation or stabilization including a reticular structure having: first elements (3) spaced from each other and having an elongated conformation according to a first trajectory (T1), second elements (4) spaced from each other and having an elongated conformation according to a second trajectory (T2) transverse to the first trajectory (T1), the first and second elements (3, 4) intersect at nodes (5) to form meshes (6), wherein the reticular structure (2) is wrapped around a winding axis (X) to define windings grouped as: a first group of initial windings defined between a first inner winding (21) of the reticular structure and to an intermediate winding, and a second group of end windings defined between a final outer winding (23) of the reticular structure (2) and the intermediate winding.

19 Claims, 10 Drawing Sheets

(56) References Cited

U.S. PATENT DOCUMENTS

| | | | | |
|---|---|---|---|---|
| 2007/0021018 | A1* | 1/2007 | Lin | A01F 15/0715 442/3 |
| 2015/0083267 | A1* | 3/2015 | Toye | E02D 17/20 139/384 R |
| 2016/0279541 | A1* | 9/2016 | Zock | E02D 29/0291 |
| 2018/0132432 | A1* | 5/2018 | Zock | D04B 21/10 |

* cited by examiner

FIG.2A
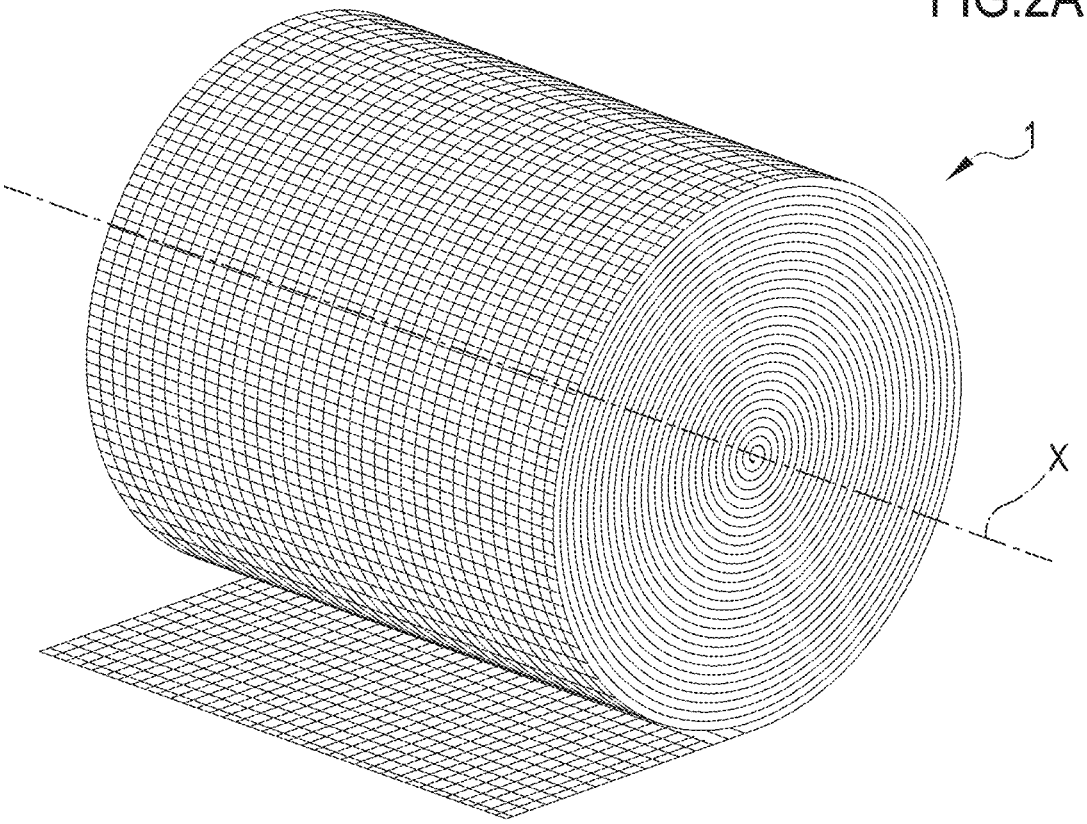
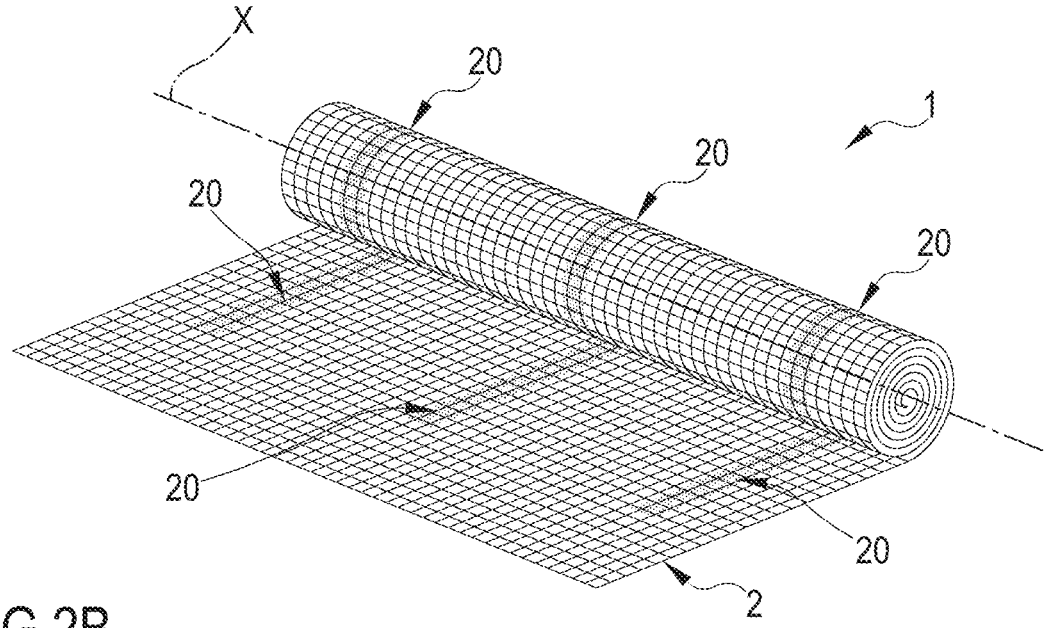
FIG.2B

ROLL

RELATED APPLICATION

This application incorporates by reference and claims priority to Italian Patent Application 102023000013959, filed on Jul. 4, 2023.

FIELD OF THE INVENTION

The present invention concerns a roll that may be used for soil consolidation and/or stabilization. The roll may be used for the construction and consolidation of grass turf, such as soccer fields, golf courses, roads and parking areas.

BACKGROUND

Nets, mono-oriented or bi-oriented, made of high-density polymers are used in the geotechnical field for reinforcement, containment, and/or consolidation of the soil. Such nets are, for example, described in U.S. patent documents: U.S. Pat. No. 5,419,659, US 2004/062615, U.S. Pat. Nos. 3,386,876, 7,407,699, and 6,423,394. Alternatively, the known nets may be made by extrusion of a monolithic grid as, for example, described in U.S. Pat. Nos. 4,662,946 and 5,753,337. The above nets are chemically inert and have excellent tensile strength in the direction of the stretched elements.

Nets for the cultivation of sod grass are also described in the PCT patent application WO 2020/252233 A1. Nets are made by a mixture of PBS, PLA and a degrading additive.

Known nets, at the end of the production process, are wrapped around a cylinder to make a roll; in this way, the nets are easily stored and transported. For example, patent application EP0985616A2 describes a roll made of sheet material onto which is adhered, along the entire longitudinal extension of the sheet, a band indicating the amount of the available material.

However, the Applicant pointed out that the known nets are difficult to control during the installation process, especially in relation to installations requiring the unwinding of long tracts.

SUMMARY OF THE INVENTION

The present invention may be embodied to provide a roll that is flexible in use and that is easily installed and controlled during the installation process but that, at the same time, can be manufactured cost-effectively. It is then an object of the present invention to provide a roll including a reticular structure with high mechanical strength capable of consolidating the soil.

In an aspect, a roll (1) comprising a reticular structure (2) is provided, the reticular structure includes: a plurality of first elements (3) spaced from each other and having an elongated conformation according to a first trajectory (T1), a plurality of second elements (4) spaced from each other and having an elongated conformation according to a second trajectory (T2) transverse to the first trajectory (T1), wherein said first and second elements (3, 4) intersect at nodes (5) to form meshes (6), wherein the reticular structure (2) is wrapped around a winding axis (X) to define a plurality of windings, wherein said plurality of windings comprises: a group of initial windings defined between a first inner winding (21) of the reticular structure and to an intermediate winding, a group of end windings defined between a final outer winding (23) of the reticular structure (2) and said intermediate winding.

In an aspect according to the preceding aspect, the roll (1) comprises at least one marker (20) arranged at either the group of initial windings or the group of end windings of the reticular structure (2). In an aspect according to any one of the preceding aspects, the marker (20) is only arranged at the group of initial windings. In an aspect according to any one of the preceding aspects the group of end windings is devoid of said marker (20). In an aspect according to any one of the preceding aspects the marker (20) is configured to (optionally visually) differentiate the reticular structure of the group of initial windings from the reticular structure of the group of end windings.

In an aspect according to any one of the preceding aspects the group of initial windings has a predetermined number of windings, wherein the ratio between the predetermined number of windings of the group of initial windings and the total number of windings of the reticular structure (2) is lower than 0.2, optionally it is lower than 0.1, even more optionally it is between 0.05 and 0.001. In an aspect according to any one of the preceding aspects a predetermined number of windings of the group of initial windings of the reticular structure comprises said marker (20). In an aspect according to any one of the preceding aspects all windings of the group of initial windings comprise said marker (20).

In an aspect according to any one of the preceding aspects the total number of windings of the reticular structure (2) is greater than 150, optionally between 200 and 800. In an aspect according to any one of the preceding aspects the predetermined number of windings of the group of initial windings is lower than 70, optionally between 10 and 50.

In an aspect according to any one of the preceding aspects the reticular structure (2) has a total length (optionally measured along said windings). In an aspect according to the preceding aspect the total length of the reticular structure (2) is greater than 2000 meters, optionally between 2500 and 10000 meters, even more optionally between 2500 and 8000 meters. In an aspect according to any one of the preceding aspects the reticular structure defining the group of initial windings has a predetermined length (optionally measured along said windings). In an aspect according to the preceding aspect, the ratio between the total length of the reticular structure (2) and the predetermined length of the reticular structure defining the group of initial windings is lower than 0.2, optionally it is lower than 0.1, even more optionally it is between 0.05 and 0.001. In an aspect according to any one of the two preceding aspects the predetermined length of the reticular structure defining the group of initial windings is lower than 200 meters, optionally between 50 and 150.

In an aspect according to any one of the preceding aspects the portion of the reticular structure (2) defining the final outer winding (23) defines at least part of an outer lateral surface of the roll (1). In an aspect according to any one of the preceding aspects, the reticular structure (2) is wrapped between a first and a second longitudinal edge (2*a*, 2*b*) to define the plurality of windings. In an aspect according to the preceding aspect, the first longitudinal edge (2*a*) is part of the first inner winding (21). In an aspect according to any one of the two preceding aspects the second longitudinal edge (2*b*) is part of the final outer winding (23).

In an aspect according to any one of the preceding aspects the roll (1) has an outer diameter greater than 200 mm, optionally between 250 and 900 mm, even more optionally between 250 and 700 mm. In an aspect according to any one of the preceding aspects the final outer winding (23) of the wrapped reticular structure (2) substantially defines the outer diameter of the roll (1). In an aspect according to any one of the two preceding aspects the diameter of the roll (1) is substantially defined by the diameter of the outer side surface of the reticular structure. In an aspect according to any one of the two preceding aspects, the roll diameter (1) is substantially defined by the diameter of the final outer winding (23) of the reticular structure (2).

In an aspect according to any one of the preceding aspects, the roll (1) extends along the winding axis (X) between a first and a second head portion (1*a*, 1*b*). In an aspect according to the preceding aspect, the distance present between the first and second head portions (1*a*, 1*b*) substantially defines a height of the roll (1). In an aspect according to any one of the two preceding aspects the distance between the first and second head portions (1*a*, 1*b*) is greater than 0.5 meters, optionally between 1 meter and 9 meters, even more optionally between 1 meter and 7 meters.

In an aspect according to any one of the preceding aspects, the first inner winding (21) defines a longitudinal seat (15) extending along the winding axis (X). In an aspect according to the preceding aspect the longitudinal seat (15) extends the entire extension of the roll (1) along said axis of winding (X). In an aspect according to any one of the two preceding aspects the first inner winding (21) delimits an inner side surface of the roll (1) which delimits said longitudinal seat (15). In an aspect according to the preceding aspect the inner lateral surface of the roll (1) defines an inner diameter of the roll (1) between 50 mm and 250 mm, optionally between 60 mm and 220 mm.

In an aspect according to any one of the preceding aspects the group of initial windings is placed close to the longitudinal seat (15). In an aspect according to any one of the preceding aspects the group of end windings is spaced apart from the longitudinal seat (15). In an aspect according to any one of the preceding aspects the group of initial windings is interposed between the longitudinal seat (15) and the group of end windings of the reticular structure (2).

In an aspect according to any one of the preceding aspects the marker (20) is an integral part of the reticular structure and/or is applied on the reticular structure (2), optionally applied to a surface of the reticular structure (2). In an aspect according to any one of the preceding aspects the marker (20) is applied and/or defines at least a part of the reticular structure (2) of the group of initial windings.

In an aspect according to any one of the preceding aspects the marker (20) extends throughout a longitudinal extension of the reticular structure (2) defining the group of initial windings. In an aspect according to any one of the preceding aspects the marker (20) is present on the reticular structure defining the group of initial windings. In an aspect according to any one of the preceding aspects the marker (20) extends for at least a part of the reticular structure extension defined from the first inner winding (21) to the intermediate winding or extends from the final outer winding (23) to the intermediate winding. In an aspect according to any one of the preceding aspects, the marker (20) extends only for the entire tract of the reticular structure extending from the first inner winding (21) to the intermediate winding.

In an aspect according to any one of the preceding aspects, the marker (20) is present on the reticular structure starting basically from the first longitudinal edge (2*a*) of the reticular structure (2) to a portion of the reticular structure (2) that defines the intermediate winding.

In an aspect according to any one of the preceding aspects, the marker (20) is applied on the reticular structure and is capable of (optionally visually) distinguishing the reticular structure of the group of initial windings from the group of end windings. In an aspect according to any one of the preceding aspects, the marker (20) comprises at least one of: a paint, an ink, a magnetic element (e.g., a magnetic band); wherein said marker (20) is applied on the reticular structure (2). In an aspect according to any one of the preceding aspects, the marker (20) is insoluble in water. In an aspect according to any one of the preceding aspects the marker (20) comprises at least one strip extending longitudinally (optionally only) along at least a portion of the windings of the group of initial windings, optionally the at least one strip extending along the entire reticular structure defining the group of initial windings. In an aspect according to any one of the preceding aspects the at least one strip has a width measured along the winding axis (X) that is lower than the extension of the reticular structure (1) along said winding axis (X). In an aspect according to the preceding aspect, the ratio between the extension of the reticular structure (2) along the winding axis (X) and the width of said at least one strip of the marker (20) is greater than 2, optionally it is between 2 and 100. In an aspect according to any one of the preceding aspects, the width of the marker strip (20) is greater than 50 mm, optionally it is between 60 and 300 mm.

In an aspect according to any one of the preceding aspects the at least one strip of the marker (20) comprises at least one first and one second strip (20*a*, 20*b*) side by side. In an aspect according to any one of the preceding aspects the at least one strip marker of the marker (20) comprises at least one first and one second strip (20*a*, 20*b*) spaced from each other with respect to the winding axis (X) of the reticular structure (2). In an aspect according to any one of the preceding aspects the at least one strip of the marker (20) comprises a first, a second and a third strip (20*a*, 20*b*, 20*c*) side by side with each other. In an aspect according to any one of the preceding aspects the at least one strip of the marker (20) comprises a first, a second and a third strip (20*a*, 20*b*, 20*c*) spaced from each other with respect to the winding axis (X) of the reticular structure (2). In an aspect according to any one of the two preceding aspects, the second strip (20*b*) is spaced and interposed between the first and third strips (20*a*, 20*c*). In an aspect according to any one of the three preceding aspects, the second strip (20*b*) is defined substantially at a transverse centreline of the reticular structure (2). In an aspect according to any one of the four preceding aspects, the second strip (20*b*) is arranged substantially at an equal distance from the first and a second head portion (1*a*, 1*b*). In an aspect according to any one of the five preceding aspects, the first strip (20*a*) of the marker (20) is arranged in close proximity to the first head portion (1*a*) of the roll (1). In an aspect according to any one of the six preceding aspects the third strip (20*c*) of the marker (20) is arranged in the proximity of the second head portion (1*b*) of the roll (1). In an aspect according to any one of the seven preceding aspects the first strip (20*a*) of the marker defines at least a part of the first head portion (1*a*) of the roll, optionally said first strip (20*a*) is visible from outside the roll (1). In an aspect according to any one of the eight preceding aspects, the third strip (20*c*) of the marker defines at least a part of the second head portion (1*b*) of the roll, optionally said third strip (20*c*) is visible from the outside of the roll (1).

In an aspect according to any one of the preceding aspects, the marker (20) applied on the reticular structure (2) defining the group of initial windings has a different colouring from the colouring of the reticular structure defining the group of end windings.

In an aspect according to any one of the preceding aspects the reticular structure (2) extends in thickness substantially between a bottom surface and a top surface. In an aspect according to the preceding aspect the thickness of the reticular structure (2) is lower than 3 mm, optionally between 0.1 and 1.5 mm. In an aspect according to any one of the two preceding aspects the marker (20) is applied to at least one of said lower surface and upper surface of the reticular structure (2). In an aspect according to any one of the three preceding aspects the marker (20) is applied only on the upper surface of the reticular structure (2).

In an aspect according to any one of the preceding aspects the first elements (3) are substantially parallel to each other, optionally the first trajectories (T1) of the first elements (3) are parallel to each other. In an aspect according to any one of the preceding aspects the first elements (3) extend along the plurality of windings of the reticular structure (2). In an aspect according to any one of the preceding aspects each first element extends along the total length of the reticular structure (2), optionally said length is measured along the windings, even more optionally along a plane orthogonal to the winding axis (X) of the reticular structure. In an aspect according to any one of the preceding aspects, the length of each first element (3) substantially corresponds to the length of the reticular structure (2). In an aspect according to any one of the preceding aspects each first element (3) extends in length between the first and second longitudinal edges (2*a*, 2*b*) of the reticular structure (2). In an aspect according to any one of the preceding aspects the first elements (3) of the reticular structure are spaced apart with respect to a direction parallel to the winding axis (X) of the reticular structure (3). In an aspect according to the preceding aspect the distance between two immediately consecutive first elements with respect to the winding axis (X) is between 15 and 70 mm, optionally between 15 and 50 mm. In an aspect according to any one of the preceding aspects each first element (3) extends along the plurality of windings of the reticular structure (2). In an aspect according to any one of the preceding aspects the first elements (3) have a length greater than 2000 meters, optionally between 2500 and 10000 meters, even more optionally between 2500 and 8000 meters.

In an aspect according to any one of the preceding aspects the first elements (3) are stretched along their development. In an aspect according to the preceding aspect the stretching ratio of a first element (3) is defined as the ratio of a final length of the same first element (3) once stretching is performed to the initial length of that first element before the stretching action. In an aspect according to any one of the preceding aspects, the first elements (3) have a stretching ratio greater than 1.5, optionally between 2 and 8, more optionally between 2.5 and 4; optionally, the stretching ratio of the first elements (3) is defined as the ratio between a final length of said first elements after a stretching action of said first elements and an initial length of said first elements before stretching.

In an aspect according to any one of the preceding aspects said first elements (3) have a substantially filiform shape. In an aspect according to any one of the preceding aspects said first elements (3) have a cross-sectional area, measured at a centreline portion defined between two immediately consecutive nodes, lower than 5 $mm^2$, optionally between 0.1 $mm^2$ and 1.5 $mm^2$.

In an aspect according to any one of the preceding aspects the second trajectory (T2) of the second elements (4) is substantially parallel to the winding axis (X). In an aspect according to any one of the preceding aspects the second trajectory (T2) of the second elements (4) is straight. In an aspect according to any one of the preceding aspects the second trajectory of each second element (4) is substantially orthogonal to the first trajectory (T1) of the first elements (3).

In an aspect according to any one of the preceding aspects the second elements (4) are parallel to each other. In an aspect according to any one of the preceding aspects the second trajectories (T2) of the second elements are parallel to each other. In an aspect according to any one of the preceding aspects each second element (4) extends in length along the second trajectory (T2). In an aspect according to any one of the preceding aspects each second element extends between the first and second head portions (1*a*, 1*b*) of the roll (1). In an aspect according to any one of the preceding aspects the length of each second element (4) substantially corresponds to the height of the roll (1). In an aspect according to any one of the preceding aspects each second element (4) has a length greater than 0.5 meters, optionally between 1 meter and 9 meters, even more optionally between 1 meter and 7 meters. In an aspect according to any one of the preceding aspects the second elements (4) are spaced apart. In an aspect according to any one of the preceding aspects two immediately consecutive second elements (4) along the windings are placed at a minimum distance between 15 and 70 mm, optionally between 15 and 50 mm.

In an aspect according to any one of the preceding aspects the second elements (4) are stretched along their development. In an aspect according to the preceding aspect, the stretching ratio of a second element (4) is defined as the ratio between a final length of the same second element (4) once stretching is performed and the initial length of that second element before the stretching action.

In an aspect according to any one of the preceding aspects the second elements (4) have a stretching ratio greater than 1.5, optionally between 2 and 5, more optionally between 2 and 4; optionally the stretching ratio of the second elements (4) being defined as the ratio between a final length of the second elements after a stretching action of the second elements and an initial length of the second elements before stretching.

In an aspect according to any one of the preceding aspects the second elements (4) have a substantially filiform shape. In an aspect according to any one of the preceding aspects the second elements (4) have a cross-sectional area, measured at a centreline portion defined between two immediately consecutive nodes, lower than 5 $mm^2$, optionally between 0.1 $mm^2$ and 1.5 $mm^2$.

In an aspect according to any one of the preceding aspects, the ratio between the distance between two adjacent first elements and the distance between two adjacent second elements is between 0.5 and 2, optionally between 0.8 and 1.2.

In an aspect according to any one of the preceding aspects the first elements (3) are substantially identical to the second elements (4). In an aspect according to any one of the preceding aspects the first elements (3) are identical in shape to the second elements (4). In an aspect according to any one of the preceding aspects the first elements are identical in size to the second elements (4).

In an aspect according to any one of the preceding aspects the reticular structure (2) comprises meshes (6) having a quadrilateral shape, optionally having a square or rectangular shape. In an aspect according to any one of the preceding aspects, the size of each mesh (6) is defined by the distance of two immediately consecutive first elements and the distance of two immediately consecutive second elements which intersect at said two immediately consecutive first elements.

In an aspect according to any one of the preceding aspects, the first elements (3) and/or said second elements (4) have a full cross-sectional area. In an aspect according to any one of the preceding aspects, the ratio between a cross-sectional area of a first element (3), measured at an intermediate portion between two immediately consecutive nodes (5), and a cross-sectional area of a second element (4), also measured at an intermediate portion between two immediately consecutive nodes (5), is between 0.5 and 2, optionally between 0.8 and 1.2.

In an aspect according to any one of the preceding aspects the reticular structure (2) has a weight between 5 $g/m^2$ and 20 $g/m^2$, optionally between 5 $g/m^2$ and 10 $g/m^2$. In an aspect according to any one of the preceding aspects the reticular structure (2) has a specific tensile strength, along the trajectory of the first and/or second elements (3, 4) equal to or greater than 0.5 kN/m, specifically ranging between 0.7 kN/m and 10 kN/m, optionally between 0.7 kN/m and 3 kN/m; said specific tensile strength being measured by the method set forth in ASTM D7179.

In an aspect according to any one of the preceding aspects the reticular structure (2) of the roll (1) may comprise a transverse junction, which joins in a single piece two longitudinal tracts of the reticular structure, wherein the roll (1) may comprise an auxiliary marker placed at said transverse junction. In an aspect according to the preceding aspect, the auxiliary marker is configured to signal to a user the presence of the reticular structure transverse junction. In an aspect according to any one of the preceding aspects the auxiliary marker extends at least partially along the reticular structure, substantially parallel to the junction. In an aspect according to any one of the three preceding aspects the auxiliary marker extends across the entire width of the reticular structure (2). In an aspect according to any one of the four preceding aspects the auxiliary marker may comprise at least one of: a colouring applied (optionally superficially) to the reticular structure, a band made of textile material, a band made of nonwoven material, a band made of metallic material. In an aspect according to any one of the five preceding aspects the auxiliary marker comprises at least one of: a paint, an ink, a magnetic element.

In an aspect according to any one of the preceding aspects the first and second elements (3, 4) are obtained by stretching a semifinished product (2') with reticular structure presenting first and second precursor elements (3', 4') intersecting at nodes to define meshes. In an aspect according to the preceding aspect the semi-finished product (2') with reticular structure is obtained by: an extrusion process, or extrusion of a solid sheet subsequently cut.

In an aspect according to any one of the two preceding aspects the semi-finished product (2') reticular structure is obtained by an extrusion process with pulsating technology. In an aspect according to any one of the preceding aspects the reticular structure (2) is obtained by an extrusion process with pulsating technology.

In an aspect according to any one of the preceding aspects the reticular structure (2) is used to perform at least one of: soil consolidation, soil reinforcement. In an aspect according to any one of the preceding aspects the reticular structure (2) is monolithic. In an aspect according to any one of the preceding aspects the reticular structure (2) is made at least partially of plastic material. In an aspect according to any one of the preceding aspects the reticular structure (2) is made (optionally entirely) of at least one of the following materials: polypropylene, polylactic acid (PLA), polybutylene succinate (PBS), PBAT, PHBH, PHBV, or a mixture of two or more of said materials.

In an aspect a process of making the roll (1) in accordance with any one of the preceding aspects is provided. In an aspect according to the preceding aspect the process comprises the steps of: providing the reticular structure (2), and wrapping said reticular structure around the winding axis to define said roll (1).

In an aspect according to the preceding aspect, the process also includes a step of defining a marker (20) on the roll (1). In an aspect according to the preceding aspect the marker (20) is applied to the reticular structure (2). In an aspect according to any one of the two preceding aspects the marker (20) is applied on the reticular structure before and/or during the step of wrapping said reticular structure in roll. In an aspect according to any one of the three preceding aspects the marker (20) comprises at least of a paint, an ink a magnetic element; optionally applied superficially on the reticular structure (2). In an aspect according to any one of the four preceding aspects the marker has a coloration different from the coloration of the reticular structure.

In an aspect according to any one of the preceding aspects, the step of providing the reticular structure (2) comprises at least one plastic extrusion step. In an aspect according to the preceding aspect the extruded plastic material comprises at least one of: polypropylene, polylactic acid (PLA), polybutylene succinate (PBS), PBAT, PHBH, PHBV, or a mixture of two or more of said materials.

In an aspect according to any one of the preceding aspects, the process comprises the sub-steps of: extruding a semi-finished product (2') with a monolithic reticular structure presenting first and second precursor bodies (3', 4') of elongated shape and extending along respective transverse developmental trajectories, optionally orthogonal to each other, the first and second precursor bodies intersecting at nodes to form meshes, and stretching the semi-finished product along the development of the first and/or second precursor bodies so as to define a stretched reticular structure (2), optionally having said first and second elements (3, 4).

In an aspect according to the preceding aspect, the process comprises a step of stretching the semi-finished product (2') along the development of the first and second precursor bodies so as to define said reticular structure (2) having said and first and second elements (3, 4) stretched along their development, optionally to define a bi-stretched reticular structure (2). In an aspect according to any one of the two preceding aspects, the stretching step is performed along the development of the first and second precursor bodies to define a bi-stretched reticular structure. In an aspect according to any one of the three preceding aspects, the application of the marker on the reticular structure is performed following the stretching step and preceding the roll-up step.

In an aspect according to any one of the preceding aspects, the semi-finished product (2') is obtained continuously by an extrusion process, optionally by pulsating technology. In an aspect according to any one of the preceding aspects, the extrusion step comprises the sub-steps of:

extruding said monolithic semifinished product (2') in cylindrical form wherein the first precursor bodies extend along one direction of extrusion while the second precursor bodies, each of which has a substantially circular shape, extend transversely, optionally orthogonally, to the first precursor bodies, moving said monolithic semi-finished product along one advancement direction (MD), cooling said monolithic semi-finished product, cutting said monolithic semifinished product having a circular shape along the advancement direction (MD) so that the same semifinished product may be opened and subsequently laid out in a flat shape wherein said first precursor bodies extend parallel to the advancement direction (MD) while said second precursor bodies extend transversely, optionally orthogonally, to said advancement direction (MD).

In an aspect according to the preceding aspect, the extrusion of the monolithic semifinished product with reticular structure is followed by means of a cylindrical extrusion head with pulsating technology. In an aspect according to any one of the two preceding aspects, the stretching step is performed following the extension and cuts step of the semi-finished product (2').

In an aspect according to any one of the preceding aspects, the monolithic reticular structure semifinished product (2'), when opened and lying in a flat form, has said first and second precursor bodies (3', 4') lying substantially in the same plane. In an aspect according to any one of the preceding aspects, the first precursor bodies extend substantially parallel to the advancement direction (MD) of the semi-finished product (2').

In an aspect according to any one of the preceding aspects, the stretching step is performed on the monolithic reticular structure semi-finished product following the cutting step. In an aspect according to any one of the preceding aspects, the stretching step is performed on the monolithic semi-finished product having a reticular structure when opened in a flat form along at least one stretching direction. In an aspect according to any one of the preceding aspects, the stretching step is performed on the monolithic semi-finished product having a reticular structure when opened in a flat form along at least one stretching direction.

In an aspect according to any one of the preceding aspects, the stretching step of the monolithic semi-finished product with reticular structure is performed along at least one of the following directions:

a stretching direction substantially parallel to the advancement direction (MD), optionally parallel to the developmental trajectory of the first precursor bodies, a stretching direction substantially orthogonal to the advancement direction (MD), optionally parallel to the development trajectory of the second precursor bodies.

In an aspect according to any one of the preceding aspects, the stretching step of the monolithic semi-finished product is performed along the development trajectories of the first and second precursor bodies to define a reticular structure (2) with first and second elements (3, 4) stretched along their development.

In an aspect according to any one of the preceding aspects the extrusion step is carried out at a temperature between 110° C. and 260° C., optionally between 150° C. and 220° C. In an aspect according to any one of the preceding aspects the stretching step is carried out at a temperature between 65° C. and 150° C. In an aspect according to any one of the preceding aspects the stretching step of the first precursor bodies (3') is performed at a temperature between 75° C. and 100° C. In an aspect according to any one of the preceding aspects, the stretching step of the first precursor bodies is performed in a water bath. In an aspect according to any one of the preceding aspects the stretching step of the second precursor bodies (4') is performed at a temperature between 85° C. and 150° C. In an aspect according to any one of the preceding aspects, the stretching step of the second precursor bodies is performed in air, optionally in a case within which air heated to a temperature between 85° C. and 150° C. is present. In an aspect according to any one of the preceding aspects, the extrusion step is carried out at a speed between 5 meters/minute and 12 meters/minute, optionally between 6 meters/minute and 10 meters/minute. In an aspect according to any one of the preceding aspects, the stretching speed of the first precursor bodies to define said first (3) stretched elements is carried out, along the advancement direction (MD), at a speed between 20 meters/minute and 40 meters/minute. In an aspect according to any one of the preceding aspects the stretching speed of the second precursor bodies to define said second elements (4) stretched is carried out, along a direction orthogonal to the advancement direction (MD), at a speed between 10 meters/minute and 100 meters/minute, optionally between 20 meters/minute and 50 meters/minute.

In an aspect an apparatus for manufacturing the roll according to the any one of the preceding aspect, is provided. In an aspect according to the preceding aspect the apparatus is configured to perform the making process in accordance with any one of the preceding aspects.

In an aspect according to any one of the above, the apparatus comprises: a reticular structure forming station (2), a marker application station (20), and a winding station (106) configured to wind the reticular structure (2) around the winding axis to form said roll (1).

In an aspect according to the preceding aspect, the forming station comprises an extrusion station (100). In an aspect according to the preceding aspect, the extrusion station is configured to form E a semi-finished product (2') having a monolithic reticular structure in tubular form and move said semi-finished product along an advancement trajectory, wherein the apparatus further comprises:

a cutting station (101) configured to receive and longitudinally cut said tubular semifinished product, an opening station (102) located downstream of the cutting station with respect to the advancement direction of the semi-finished product, said opening station (102) being configured to arrange said semi-finished product substantially in a flat configuration.

In an aspect according to any one of the preceding aspects, the apparatus (100) comprises at least one application station (105) of the marker (20) placed downstream from the spreading station (102). In an aspect according to any preceding aspect the application station (105) comprises a paint station configured to apply on at least one side of the reticular structure (2) at least one strip of paint and/or ink. In an aspect according to the preceding aspect, the strip defined by the marker has a different coloration from the coloration of the reticular structure.

In an aspect according to any one of the preceding aspects the apparatus comprises at least one of:

a longitudinal stretching station (103) arranged downstream of the opening station (102) and configured to stretch the semifinished product (2') along a direction substantially parallel to the advancement trajectory of material along said apparatus, a transverse stretching station (104) arranged downstream of the opening station (102) and configured to stretch the semifinished product (2') along a transverse direction, optionally orthogonal to the advancement trajectory of material along said apparatus.

In an aspect according to the preceding aspect the application station (105) of the marker (20) is arranged downstream of the longitudinal stretching station and the transverse stretching station. In an aspect according to any one of the preceding aspects, the application station (105) of the marker (20) is arranged immediately upstream of the coiling station (106) with respect to the material advancement trajectory along said apparatus.

In an aspect a process of laying a reticular structure by unwinding a roll (1) in accordance with any one of the preceding aspects is provided. In an aspect according to the preceding aspect, the laying process comprises the steps of:

moving the entire roll (1) along an advancement trajectory, during the handling of the entire roll (1), unrolling said roll (1) around the axis of its winding so as to arrange the unrolled reticular structure (2) basically according to a flat configuration.

In an aspect according to the preceding aspect, the step of unrolling the roll (1) comprises: an initial unrolling step during which the unrolling of the roll (1) is started and the unrolling of the reticular structure of the group of end windings of the roll (1) is proceeded, and a second unwinding step, which follows said first unwinding step and during which the reticular structure (2) of the group of initial windings of the roll (1) is unwound.

In an aspect according to any one of the preceding aspects, the process comprises a step of identifying the reticular structure of the group of initial windings of the roll (1) by identification of the marker (20). In an aspect according to the preceding aspect the marker identification step (20) involves: the identification of the marker (20) present on the reticular structure of the group of initial windings, and the identification of the marker (20) present on the unrolled reticular structure.

In an aspect according to any one of the preceding aspects the identification step of the marker (20) is carried out by a user during the roll unrolling step (1). In an aspect according to any one of the preceding aspects, the identification step of the marker (20) involves the following sub-steps:

the generation of a signal by a sensor, wherein said signal is representative of a control parameter, sending said signal to a control unit configured to receive and process said signal.

In an aspect according to the preceding aspect, the control parameter is representative of at least one to of the following information: the presence of the marker on the rolled reticular structure wrapped around the axis of coiling (X), the presence of the marker (20) on the unrolled reticular structure.

In an aspect according to any one of the two preceding aspects, the control unit is configured to receive the signal from the sensor and output a signal representative of the presence or absence of the marker (20) on the reticular structure of the group of initial windings and/or the marker (20) present on the unrolled reticular structure. In an aspect according to any one of the three preceding aspects, the control unit is connected to and active in command on a signaling device (70), wherein the control unit, upon identification of the marker (20) on the group of initial windings of the reticular structure and/or the marker (20) present on the unrolled reticular structure, is configured to command the signaling device (70) to issue an alarm to inform the user of the unwinding of the group of initial windings. In an aspect according to any one of the preceding aspects, the sensor comprises at least one of: a camera, a magnetic sensor, an electrical resistance sensor, an electrical current sensor, an electrical voltage sensor, an encoder, a distance sensor.

In an aspect a process of making a turf using the reticular structure (2) of the roll (1) in accordance with any one of the preceding aspects is provided. In an aspect according to the preceding aspect, the process comprises the following steps: lay the reticular structure (2) on a portion of the ground, and sow grass seed on said portion of land on which grass seed is present.

In an aspect according to the preceding aspect the process, following the growth of grass on the portion of the land, comprises a step of cutting the ground for the delineation of the turf. In an aspect according to the preceding aspect the process comprises an additional step of harvesting, following the cut in the soil, the turf. In an aspect according to any one of the two preceding aspects, the step of cutting into the soil and harvesting the turf is carried out after a period of 6 to 14 months from the planting step of the portion of the soil.

In an aspect a use of the reticular structure (2) of the roll (1) in accordance with any one of the preceding aspects for at least one of soil consolidation, soil reinforcement, is present

BRIEF DESCRIPTION OF THE DRAWINGS

Some implementation forms and aspects of the invention will be described below with reference to the united drawings, provided for illustrative purposes only and therefore not limiting wherein:

FIGS. 2A and 2B show a roll;

DEFINITIONS AND CONVENTIONS

Figure 1:
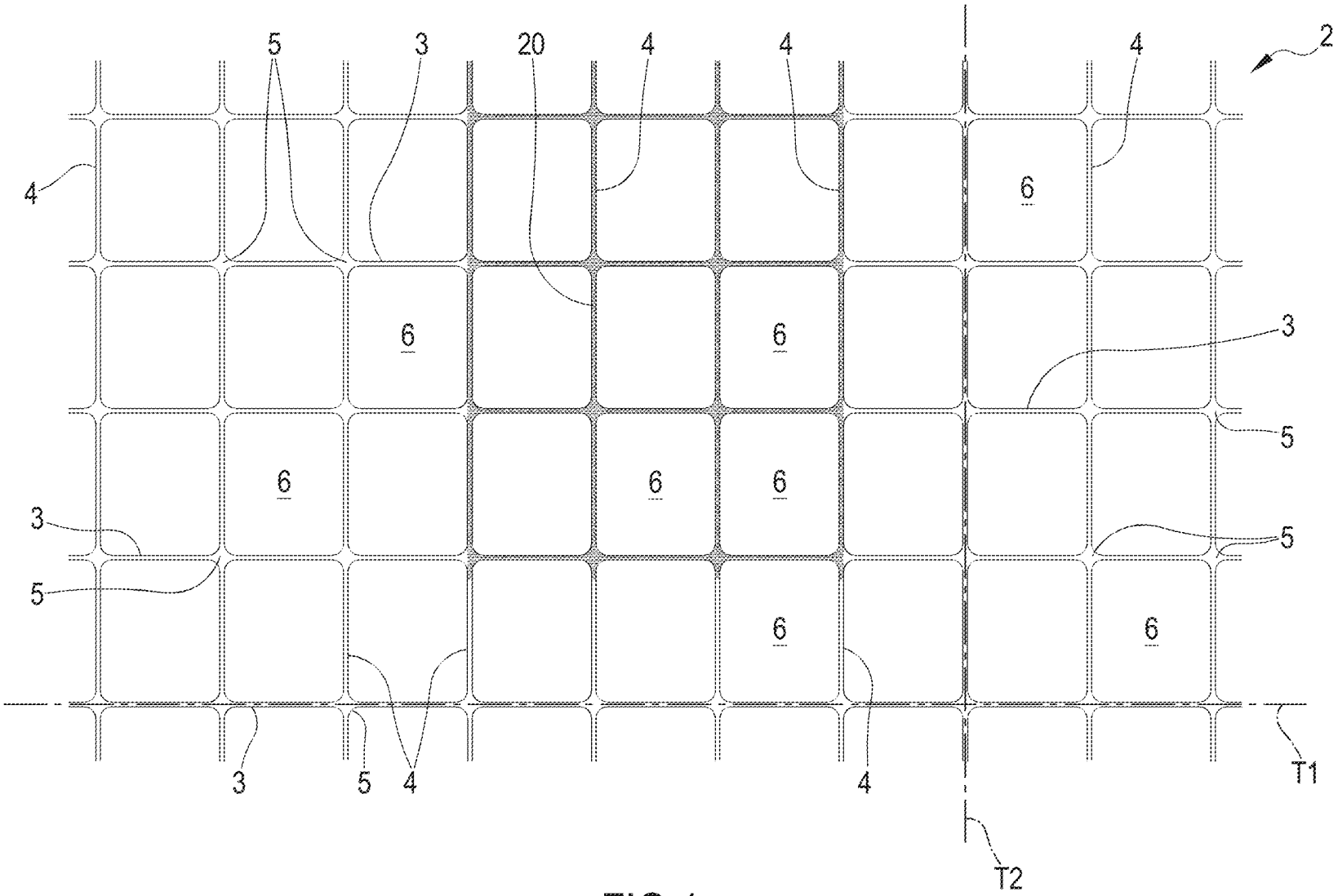
FIG. 1 shows in detail a portion of a reticular structure of a roll in accordance with the present invention.

Note that in this detailed description corresponding parts illustrated in the various figures are shown with the same numerical references. The figures may illustrate the subject matter of the invention by means of representations that are not to scale; therefore, parts and components illustrated in the figures related to the subject matter of the invention may relate only to schematic representations.

The term 'advancement direction' (MD) refers to a direction of movement of a starting semifinished product formed by an extrusion station and proceeding along an advancement trajectory through a cooling station, optionally a stretching station, and then to a collection station. Advancement direction, in the technical sector, is also called 'machine direction'.

The term "unwinding direction" refers to a direction along which a roll is unwound for laying a reticular structure (optionally a monolithic plastic mesh forming said roll) on the ground.

The term "biodegradable" refers to a material (of natural or synthetic origin) that is capable of degrading over time, optionally through enzymatic processes, e.g., through the action of bacteria, fungi, or through interaction with other microorganisms.

The term "stretched" or "stretching" in relation to first and/or second elements (3, 4) of the reticular structure (2) which is the subject of the present invention means a process for stretching said elements so as to arrange the molecular chains forming said elements (said first and/or second elements 3, 4) in an accentuated orientation along a developmental trajectory of said elements. Depending on the degree of stretching, the elements may have a more or less thin structure and may also assume substantially filiform shape. As will be better described later, the stretching is carried out from a monolithic semi-finished product with a reticular structure presenting first precursor bodies substantially spaced from each other intersected with second precursor bodies also substantially spaced from each other: the first and second precursor bodies substantially form a square or rectangular mesh wherein at least the first precursor bodies may, in a non-limiting way, extend parallel to the direction of extrusion. The stretching ratio is also defined as the ratio of a stretched element and the length of its precursor body capable of defining, as a result of the stretching action, said stretched element. In detail, the stretching ratio of the first elements is defined as the ratio of a final length of the first elements after an action of stretching the elements to an initial length of the first elements before stretching; the stretching ratio of the second elements is defined as the ratio of a final length of the second elements after an action of stretching the elements to an initial length of the second elements before stretching.

DETAILED DESCRIPTION

Roll 1

A roll 1 comprising a monolithic reticular structure 2 (FIG. 2A) that may be used for soil consolidation, soil reinforcement, soil compaction, and turf consolidation has been denoted by 1.

The reticular structure 2 comprises a plurality of first elements 3 spaced apart and having an elongated conformation according to a first T1 trajectory; the first elements 3 are interconnected to a plurality of second elements 4 also spaced apart and having an elongated conformation according to a second transverse T2 trajectory, optionally orthogonal to the first T1 trajectory: the first and second elements 3, 4 intersect at nodes 5 to form meshes 6.

The reticular structure 2 may be made at least partially of plastic material, for example, it may be obtained by extrusion of at least one of the following materials: polypropylene, polylactic acid (PLA), polybutylene succinate (PBS), PBAT, PHBH, PHBV, or a mixture of these.

The reticular structure 2 is wound in a roll around a winding axis X to define a plurality of windings. As can be seen from FIG. 2A, the roll has a substantially cylindrical shape; in fact, roll 1 has at least one outer lateral surface defining, in section according to a plane orthogonal to the winding axis X, a substantially circular outline. The roll 1 extends along the winding axis X between a first and a second head portions 1*a*, 1*b*, connected to each other by means of the outer lateral surface of the roll: the distance present between the first and the second head portions 1*a*, 1*b* substantially defines a height of the roll 1 which may be greater than 0.5 meters, optionally between 1 meter and 9 meters, even more optionally between 1 meter and 7 meters. The outer diameter of the roll, substantially defined by the diameter defined by the outer side surface, may be greater than 200 mm, optionally between 250 and 900 mm, even more optionally between 250 and 700 mm.

Thus, roll 1 may basically present a solid cylindrical shape as shown in FIGS. 2A and 2B or it may present a hollow cylinder shape. In fact, the roll may present a longitudinal seat 15, optionally also circular in shape, extending the entire extension of roll 1 along said axis of winding X: the longitudinal seat 15 may in fact extend between the first and second head portions 1*a*, 1*b* of the roll. In detail, the longitudinal seat may be delimited by an inner lateral surface of the roll presenting, in section according to a plane orthogonal to the axis of winding X, a substantially circular outline. Such an inner lateral surface of the roll defines the inner diameter of the hollow roll, which may be between 50 mm and 250 mm, optionally between 60 and 220 mm.

The plurality of windings of roll 1 comprises a group of initial windings defined between a first inner winding 21 of the reticular structure 2 and to an intermediate winding, and a group of final windings defined between a final outer winding 23 of the reticular structure 2 and said intermediate winding; specifically, the portion of reticular structure 2 defining the final outer winding 23 defines at least part of an outer lateral surface of roll 1 while the first inner winding 21 represents the winding arranged at, or directly facing, the winding axis X. In other words, the first winding 21 substantially defines the inner lateral surface of roll 1 in its hollow cylinder configuration, delimiting longitudinal seat 15. In fact, the outer diameter of roll 1 is substantially defined by the diameter of the final outer winding 23 of reticular structure 2 while the inner diameter of roll 1 in its hollow configuration is substantially defined by the diameter of the first inner winding 21 of reticular structure 2.

In FIG. 2A, a roll 1 complete with all windings (not unwound) has been schematized; in that figure, the roll presents both the group of initial windings and the group of end windings: the final outer winding of the group of end windings defines the outer side surface of the roll in FIG. 2A. FIG. 2B, on the other hand, shows roll 1 partially unwound and therefore presenting smaller dimensions than the roll shown in FIG. 2A; in FIG. 2A, only the group of initial windings i.e., the windings placed near the winding axis X or the longitudinal seat 15 are shown, as will be better described later; the group of end windings, on the other hand, is spaced from the seat 15: the group of initial windings is in fact interposed between the seat 15 and the group of end windings of the reticular structure 2.

The reticular structure 2 has, in the fully unwound condition, a substantially rectangular shape which extends from a first to a second longitudinal edge; in other words, the reticular structure 2 in the fully unwound condition substantially defines an elongated strip. The reticular structure is then wound from the first edge 2*a* to the second edge 2*b* to define said roll; the first edge then defines an inner edge of the roll, part of the first inner winding 21 while the second edge 2*b* defines an outer edge of roll 1 part of the final outer winding 23.

The intermediate winding is placed in interposition between said first inner winding 21 and said final outer winding 23; however, the intermediate winding is not placed at exactly the same distance between the first inner winding 21 and the final outer winding 23 but is arranged close to the first inner winding 21. In fact, the group of initial windings has a predetermined number of windings, wherein the ratio of the predetermined number of windings of the group of initial windings to the total number of windings of the reticular structure 2 is lower than 0.2, optionally it is lower than 0.1, even more optionally it is between 0.05 and 0.001. Therefore, it is clear that the intermediate winding is placed at a shorter distance from the first inner winding 21 than the distance present between said intermediate winding and the final outer winding.

In terms of quantity, the total number of windings of reticular structure 2 may be greater than 150, optionally ranging from 200 to 800; the predetermined number of windings of the group of initial windings may be lower than 70, optionally ranging from 10 to 50.

From the dimensional point of view, the reticular structure 2 may have a predetermined total length measured along said windings which may be greater than 2000 meters, optionally between 2500 and 10000 meters, even more optionally between 2500 and 8000 meters; the reticular structure defining the group of initial windings may have a predetermined length, again measured along said windings, which may be lower than 200 meters, optionally between 50 and 150. In fact, the ratio of the total length of the reticular structure 2 to the predetermined length of the reticular structure defining the group of initial windings may be lower than 0.2, optionally is lower than 0.1, even more optionally is between 0.05 and 0.001.

Figure 3:
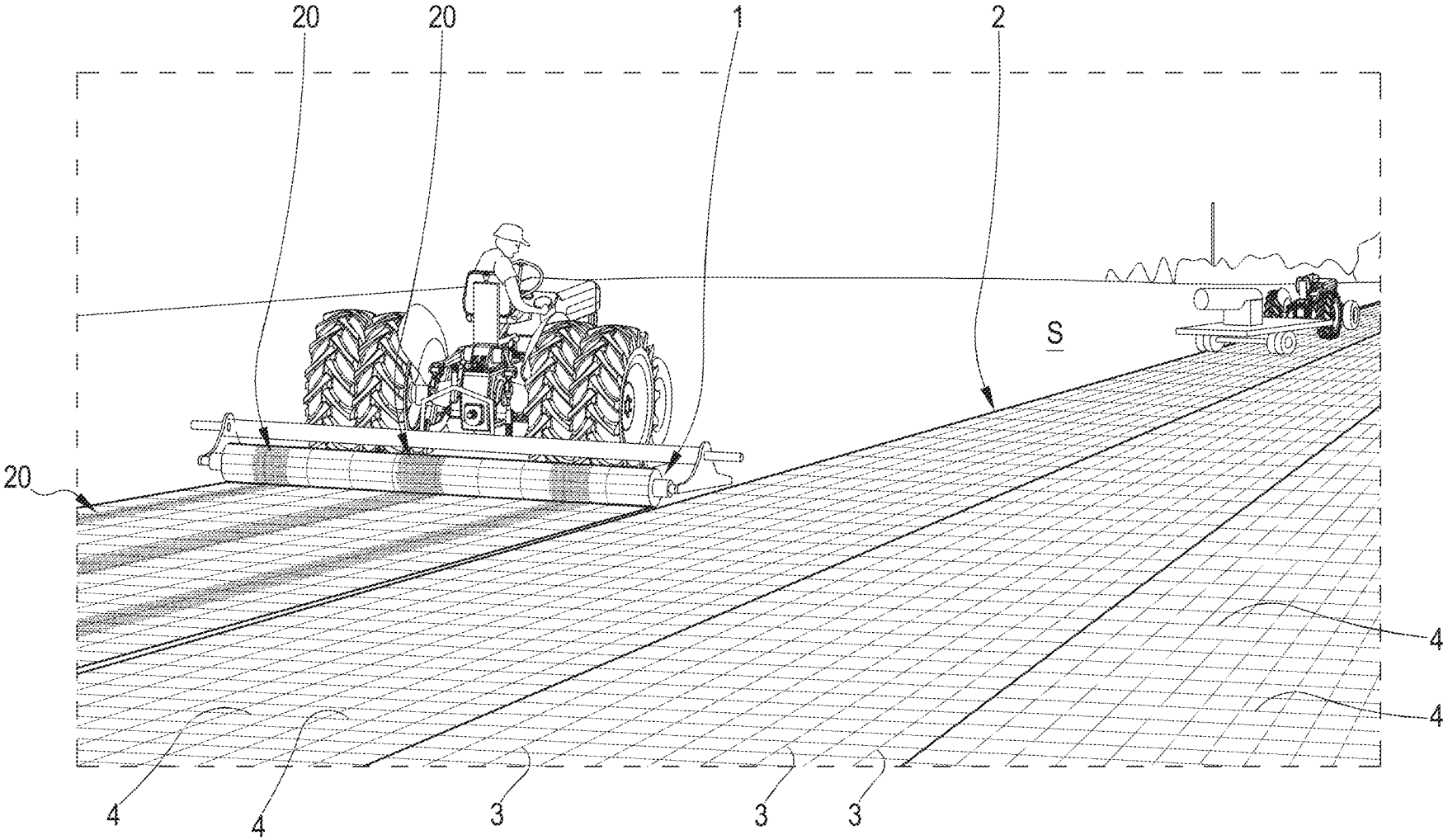
FIG. 3 schematically shows a process of laying a reticular structure of a roll in accordance with the present invention.
Figure 4:
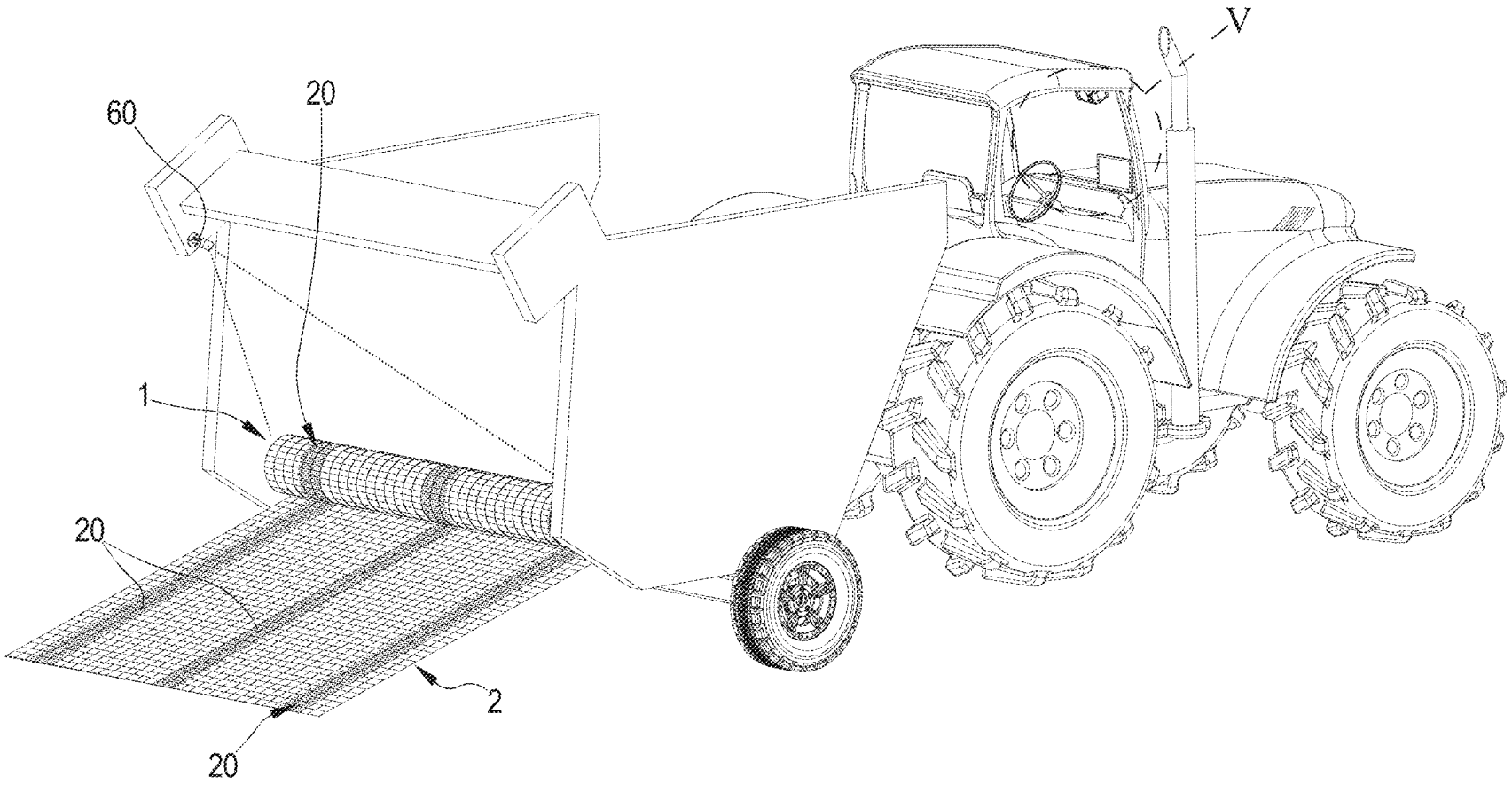
FIG. 4 shows schematically a further process of laying a reticular structure of a roll in accordance with the present invention.
Figure 5:
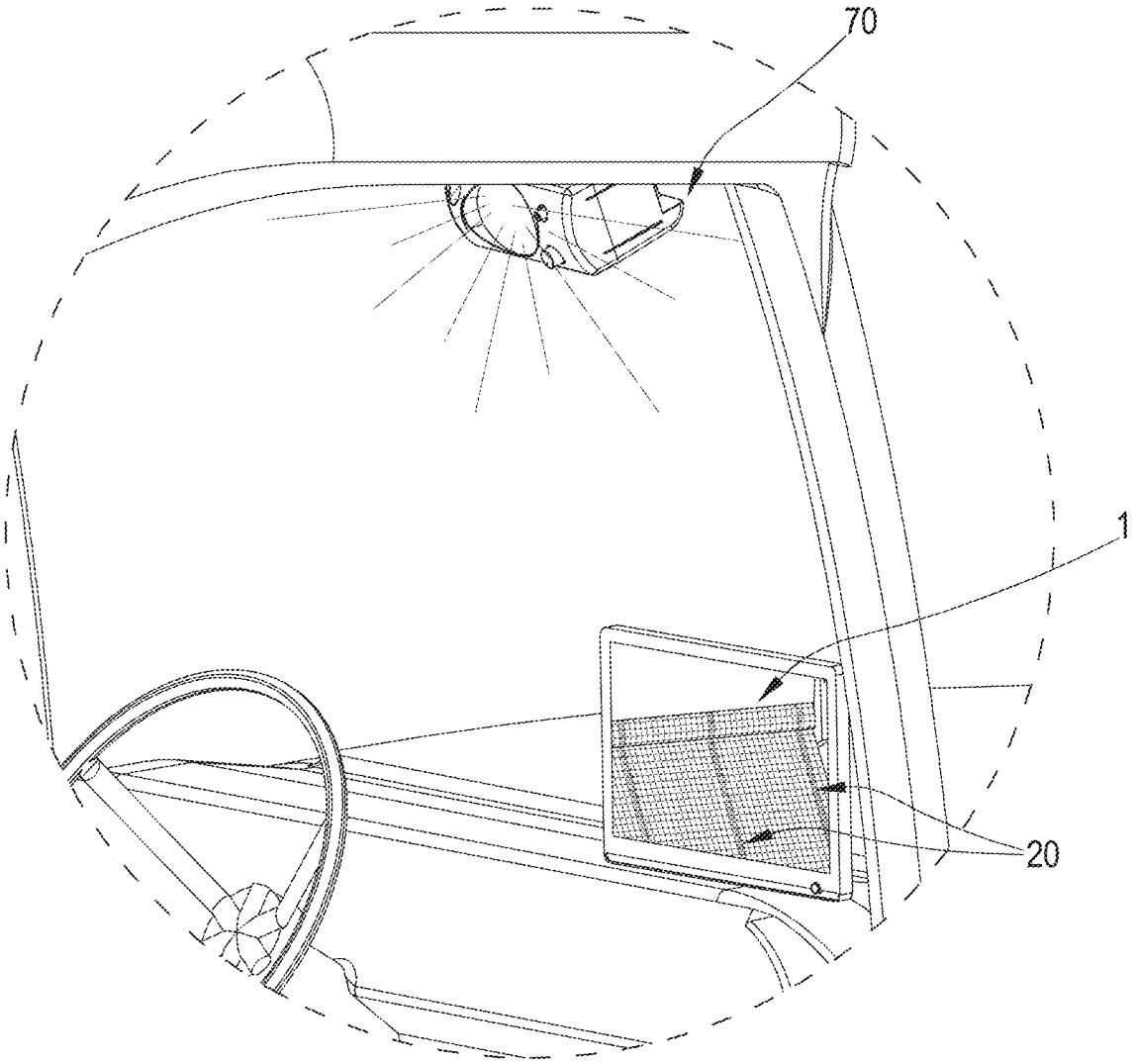
FIG. 5 is a detail (V) of FIG. 4.
Figure 6:
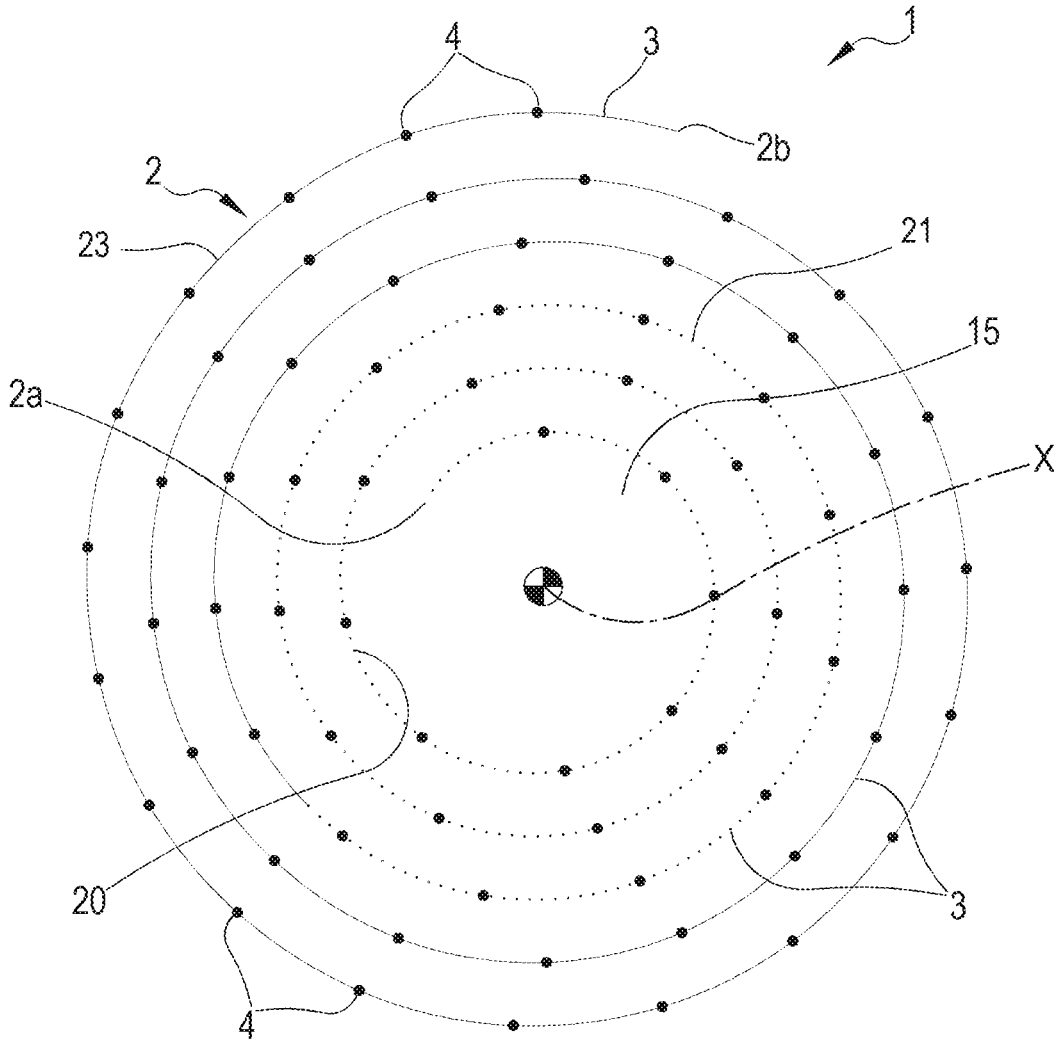
FIG. 6 is a sectional view of a roll in accordance with the present invention.
Figure 7:
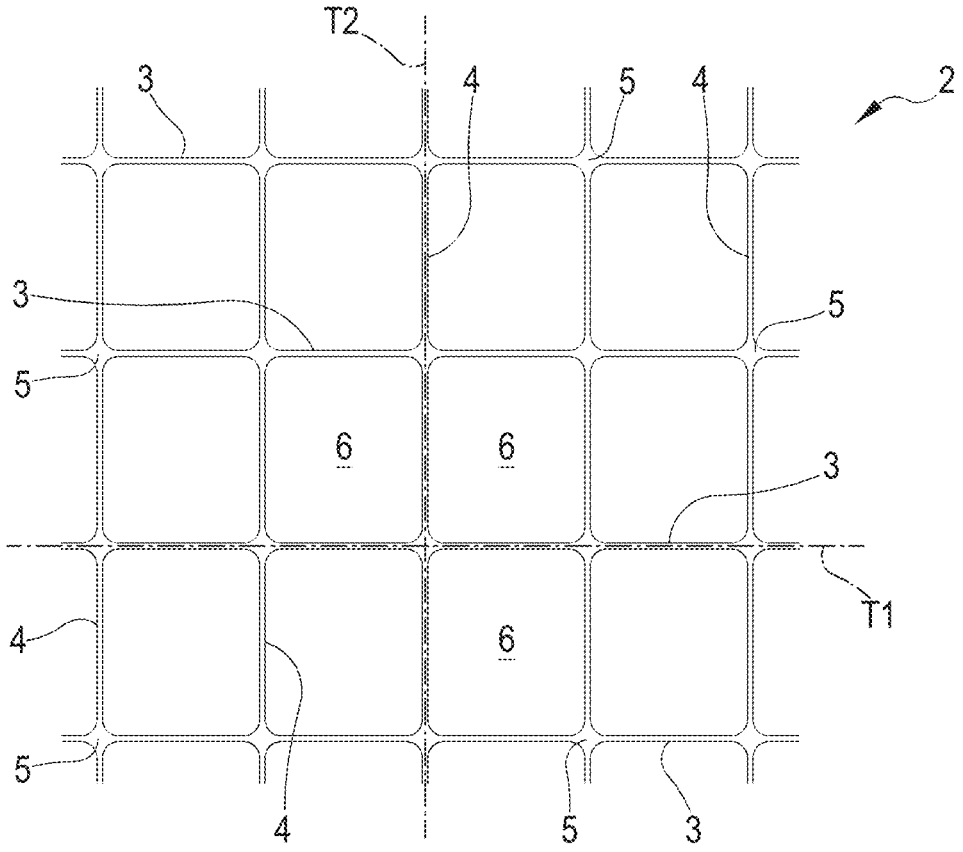
FIG. 7 is a detail view of a reticular structure of a roll in accordance with the present invention.
Figure 8:
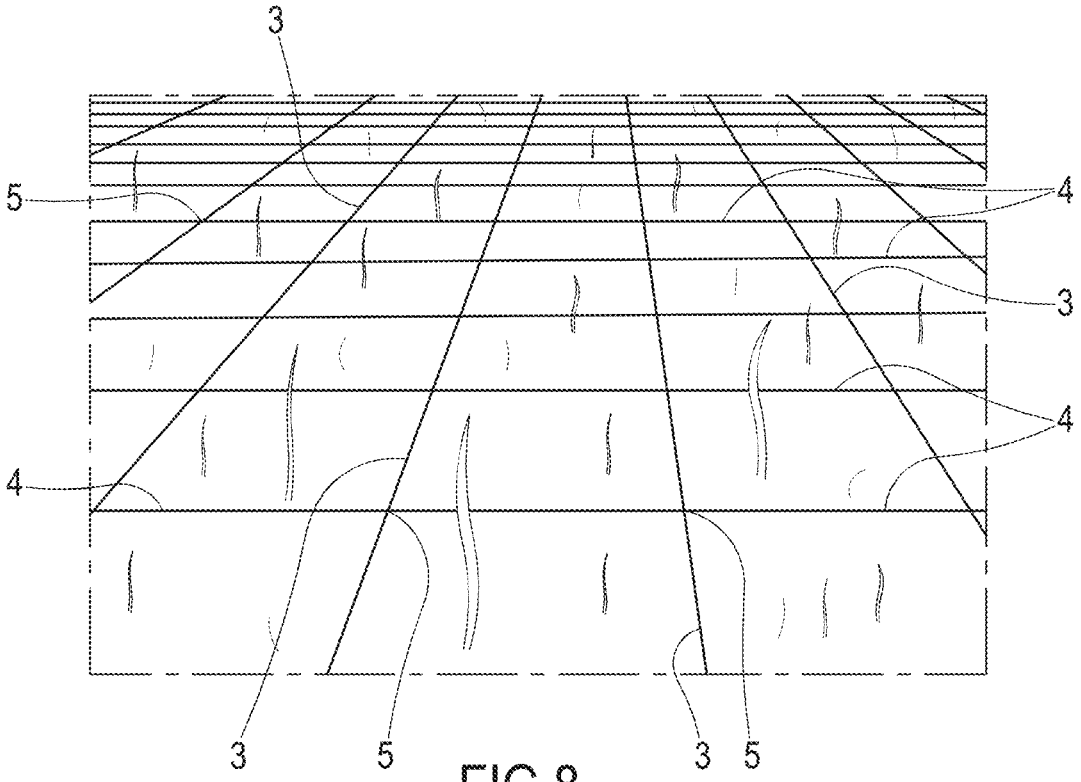
FIG. 8 shows a possible ground application of a reticular structure.

As visible, for example from FIGS. 2B, 3 and 4, roll 1 comprises at least one marker 20 configured to differentiate, optionally visually, the reticular structure 2 of the group of initial windings from the reticular structure of the group of end windings. Marker 20 may then be arranged either on the group of initial windings or on the group of end windings. In the attached figures, a roll 1 presenting a marker 20 arranged only at the group of initial windings of the reticular structure 2 has been depicted in a non-limiting way: the group of end windings is in fact devoid of said marker 20.

In FIG. 2A, only the final outer winding 23 of the group of end windings is visible from the outside of roll 1, which is found to be devoid of said marker; however, in FIG. 2B, only the group of initial windings of roll 1 is schematized, from which the presence of said marker 20 may be seen. Marker 20 is useful during the unwinding step of the reticular structure of roll 1 to provide the user with a clear identification of the reticular structure of the group of initial windings i.e., those windings defined near the winding axis X or the longitudinal seat 15 of the roll. In this way, the marker 20 may allow the user to prepare in time for a possible change of roll 1 at the end of its unwinding.

Marker 20 may be present on only part of the windings of the group of initial windings of reticular structure 2 or on all the windings of the group of initial windings. For example, marker 20 may extend throughout a longitudinal extension of the reticular structure 2 that defines the group of initial windings; in particular, marker 20 may extend from the reticular structure of the first inner winding 21: marker 20 may be present on the reticular structure starting from substantially the first edge 2*a* of reticular structure 2 to a portion of reticular structure 2 that defines the intermediate winding.

Structurally, marker 20 may be an integral part of the reticular structure and/or may be applied to reticular structure 2, optionally applied to a surface of reticular structure 2, of the group of initial windings. Wherein marker 20 results in being applied to the reticular structure this substantially defines a marker capable of optionally visually distinguishing the reticular structure 2 of the group of initial windings from the group of end windings. For example, marker 20 may comprises at least one of: a paint, an ink, a magnetic element (e.g., a magnetic strip). In the case of a paint or an ink this may have a different coloration than the coloration of the reticular structure of the group of end windings; thus, the marker 20 may allow a user or a control unit to detect said marker 20 in such a way that the reticular structure of the windings of the group of initial windings and thus the approach of the end of winding group 1 may be clearly identified when unwinding roll 1.

Wherein marker 20 is defined by one or more magnetic elements, this may be automatically identified by one or more special sensors (e.g., a magnetic sensor) configured to send to a control unit a signal representative of the identification of said magnetic element and thus the unwinding of the reticular structure of the group of initial windings.

In the case of a marker applied to the reticular structure, it may be merely resting on the reticular structure and interposed between the windings, or it may be stably applied by painting (e.g., painting by rollers or by spraying). In this condition, the marker 20 is applied superficially. The reticular structure 2 extends in thickness substantially between a bottom surface and a top surface; for example, the average thickness of reticular structure 2 may be lower than 3 mm, optionally between 0.1 and 1.5 mm. Thus, marker 20 may be applied to at least one of said bottom surface and top surface of reticular structure 2; in a non-limiting way, a marker 20 applied only to the top surface of reticular structure 2 has been illustrated in the attached figures.

A marker 20 comprising at least one strip extending longitudinally along at least a portion of the windings of the group of initial windings, optionally along the entire reticular structure 2 defining the group of initial windings, has been illustrated in a non-limiting way in the attached figures. The strip has a width measured along the winding axis X that is lower than the extension of the reticular structure 1 along said winding axis X; specifically, the ratio of the extension of the reticular structure 2 along the winding axis X to the width of said at least one strip of the marker 20 is greater than 2, optionally may be between 2 and 100. For example, the width of the marker strip 20 may be greater than 50 mm, optionally it is between 60 and 300 mm.

The at least one strip of the marker 20 may comprise at least one first and one second strip 20*a*, 20*b* side by side, in particular, spaced from each other with respect to the winding axis X of the reticular structure 2. At least one of said strips may be disposed at a transverse centreline portion of the reticular structure while the other of said strips may be disposed at either the first or the second head portion 1*a*, 1*b* of the roll 1. In particular, at least one strip may be arranged right on at least a portion of the head portion such that the marker 20 is visible of the outside of the roll 1 when observing said head portion.

In the attached figures, a roll comprising a marker 20 having a first, second and third strip 20*a*, 20*b*, 20*c* side by side, in particular spaced from each other with respect to the axis of winding X of the reticular structure 2 has been illustrated in a non-limiting way. The second strip 20*b* is spaced apart and interposed between the first and third strips 20*a*, 20*c*; in particular, the second strip 20*b* may be defined substantially at a transverse centreline of the reticular structure 2: the second strip 20*b* may be arranged substantially at an equal distance from the first and a second portion of the head 1*a*, 1*b*. The first strip 20*a* of marker 20 may be arranged near the first head portion 1*a* of roll 1 while the third strip 20*c* may be arranged near the second head portion 1*b* of roll 1. For example, the first and third strips may define at least part of their respective head portions in such a way as to be visible from outside the roll. In greater detail, the first marker strip 20*a* may define at least a portion of the first head portion 1*a* of the roll while the third marker strip 20*c* may define at least a portion of the second head portion 1*b* of the roll.

As mentioned above, the reticular structure comprises, optionally consists of, a plurality of elongated first and second elements 3, 4. The following is a detail of the structure of said elements.

In particular, each of the first elements 3 extends along the entire reticular structure 2 and is formed by a plurality of portions aligned along the same line. Similarly, each of said second elements 4 also extends along the entire reticular structure 2, transverse to the first elements 3, and is formed by a plurality of portions aligned along a same line: each of the first elements 3 is intersected by a plurality of second elements 4, and each of the second elements 4 is intersected by a plurality of first elements 3 at nodes 5 to form meshes 6. The reticular structure 2 defines a monolithic, i.e., one-piece, grid (network) consisting exclusively of said first and second elements 3, 4.

In detail, the first elements 3 have an elongated conformation according to a first T1 trajectory (FIG. 1). The T1 trajectories of the first elements 3 are substantially parallel to each other. In particular, the first elements 3 of the reticular structure are spaced apart with respect to a direction parallel to the winding axis X: specifically, the distance between two immediately consecutive first elements 3 with respect to the winding axis X is between 15 and 70 mm, optionally between 15 and 50 mm.

The first elements 3 extend along the plurality of windings of the reticular structure 2; each first element extends in length along the entire extension in length of the reticular structure 2, optionally said extension in length is measured along the windings, even more optionally along a plane orthogonal to the winding axis X of the reticular structure. In fact, the length of each first element 3 basically corresponds to the length of the reticular structure 2, that is, each first element 3 extends in length between the first and second longitudinal edge 2*a*, 2*b* of the reticular structure 2. Each first element 3 extends along the plurality of windings of the reticular structure 2 and may have a length greater than 2000 meters, optionally between 2500 and 10000 meters, even more optionally between 2500 and 8000 meters.

The first elements 3 may have, at least at a centreline portion defined between two immediately consecutive nodes 5 and orthogonally to the first trajectory T1, a section having a substantially elliptical or circular outline. We do not exclude the possibility of making first elements 3 having, at least at a portion of the centreline defined between two immediately consecutive nodes 5 and orthogonally to the second trajectory, a section having, for example, a rectangular, square, circular, or "T" shape. The first elements 3 have a substantially filiform shape and therefore have a reduced cross-sectional area throughout their development; for example, the first elements 3 may have a cross-sectional area, measured at a portion of the centreline defined between two immediately consecutive nodes, lower than 5 $mm^2$, optionally between 0.1 $mm^2$ and 1.5 $mm^2$. The cross-section remains substantially constant throughout the development of the first element 3 with an increase in cross-section at nodes where the first element widens to join with said second elements 4.

The second elements 4, also exhibit an elongated conformation according to a second T2 trajectory. As visible to the joined figures, the T2 trajectories of second elements 4 are parallel to each other. The second T2 trajectories may be straight so as to form straight and elongated second elements along parallel directions. In fact, the second T2 trajectories of the second elements 4 are substantially straight and parallel to the winding axis X: the second trajectory of each second element (4) is substantially orthogonal to the first T1 trajectory of the first elements 3.

Each second element 4 extends in length along the second trajectory T2 for the entire height of the roll. In fact, each second element extends in length between the first and second head portions 1*a*, 1*b* of roll 1. Quantitatively, each second element 4 has a length greater than 0.5 meters, optionally between 1 meter and 9 meters, even more optionally between 1 meter and 7 meters. The second elements 4 are also spaced apart: the two immediately consecutive second elements 4 along the windings are placed at a minimum distance of between 15 and 70 mm, optionally between 15 and 50 mm.

Second elements 4 having, at least at a centreline portion defined between two immediately consecutive nodes 5 and orthogonally to the second trajectory T2, a section having a substantially elliptical outline. The possibility of making second elements 4 having, at least at a centreline portion defined between two immediately consecutive nodes 5 and orthogonally to the second trajectory, a section having, for example, a rectangular, square, circular, or "T" shape, is not excluded.

Second elements 4 have a substantially filiform shape and have a reduced cross-sectional area throughout their development; for example, second elements 4 may have a cross-sectional area, measured at a defined centreline portion between two immediately consecutive nodes 5, lower than 5 $mm^2$, optionally ranging from 0.1 $mm^2$ to 1.5 $mm^2$. The cross section may be constant throughout the development of the second element 4 with an increase in cross section at nodes 5 where the second element 4 widens to join with said first elements 3.

The ratio between the distance between two adjacent first elements 3 and the distance between two adjacent second elements 4 is between 0.5 and 2, optionally between 0.8 and 1.2. The meshes 6 of the reticular structure 2 are basically square. Of course, the possibility of meshes having a different shape, e.g., rectangular, triangular or rhomboidal, is not excluded. Quantitatively, the minimum distance between two adjacent first elements 3 is between 15 mm and 70 mm, optionally between 15 mm and 50 mm. Similarly, the minimum distance between adjacent second elements 4 is between 15 mm and 70 mm, optionally between 15 mm and 50 mm. As these distances vary, the mesh size 6 varies, which may have a through area between 200 $mm^2$ and 5000 $mm^2$, optionally between 225 $mm^2$ and 3000 $mm^2$.

The reticular structure 2 may be stretched along at least one direction of extension of the first elements 3 and/or second elements 4 to define a mono-stretched and/or bi-stretched reticular structure 2; for example, the reticular structure 2 may be stretched along the development of only the first elements 3, that is, along the first trajectory T1. Reticular structure 2 may be stretched along two directions, specifically along the development of the first and second elements 3, 4 to define a bi-stretched reticular structure as illustrated, for example, in FIG. 1: in such a configuration, the reticular structure is stretched both along the first T1 trajectory and along the second T2 trajectory. The stretching ratio, i.e., the ratio of the length of the elements (first elements and/or second elements) after stretching to the length of the elements before stretching is greater than 1.5. In detail, first elements 3 are stretched along the first T1 trajectory; first elements 3 have a stretching ratio greater than 1.5, optionally between 2 and 8, more optionally between 2.5 and 4. Second elements 4 are stretched along the second T2 trajectory; second elements 4 have a stretching ratio greater than 1.5, optionally between 2 and 5, plus optionally between 2 and 4. The filiform structure of the first and second elements 3, 4 is basically defined by the stretching action, which accentuates the elongation of said elements and thins their cross section. The specific gravity of reticular structure 2 is between 5 g/m$^2$ and 20 g/m$^2$, optionally between 5 g/m$^2$ and 10 g/m$^2$.

The reticular structure has a specific tensile strength along the first and/or second elements equal to or greater than 0.5 kN/m, optionally between 0.7 kN/m and 10 kN/m, even more optionally between 0.7 kN/m and 3 kN/m; the specific tensile strength is measured by the method set forth in ASTM D7179.

The reticular structure 2 may be made at least in part in at least one of the following materials: polypropylene, polylactic acid (PLA), polybutylene succinate (PBS), PBAT, PHBH, PHBV, or a mixture of two or more of the said materials. In particular, the reticular structure 2 may be by an extrusion process using a pulsed head or a counter-rotating head; of course, the possibility of making the reticular structure by punching a flat sheet of plastic material is not excluded.

A detail view of a portion of a reticular structure is shown in FIG. 1, in which the first and second elements interwoven at knowns are visible; a portion of reticular structure 2 presenting said marker 20 has been shown merely for illustration. As visible, marker 20 defines an additional element visually distinguishable from the remaining portion of reticular structure lacking said marker 20. In fact, marker 20 represents a diversifying element that allows the user to clearly identify the portion of reticular structure 2 having said marker 20.

Roll Making Process

It also forms an object of the present invention to provide a process for making roll 1 in accordance with the above description and in accordance with any one of the attached claims.

The process involves the formation of the first and second elements 3, 4 by an extrusion process (simultaneous extrusion of the first and second elements 3, 4), optionally by a pulsating technology. Obviously, the possibility of extruding the first and second elements with an extrusion head using counter-rotating technology, is not excluded. The extrusion head is fed by means of a solid compound in granular form made by means of a well-known compounding technology. The granular solid compound may be made from at least one of the following materials: polypropylene, polylactic acid (PLA), polybutylene succinate (PBS), PBAT, PHBH, PHBV, or a mixture of two or more of the said materials.

Figure 10:
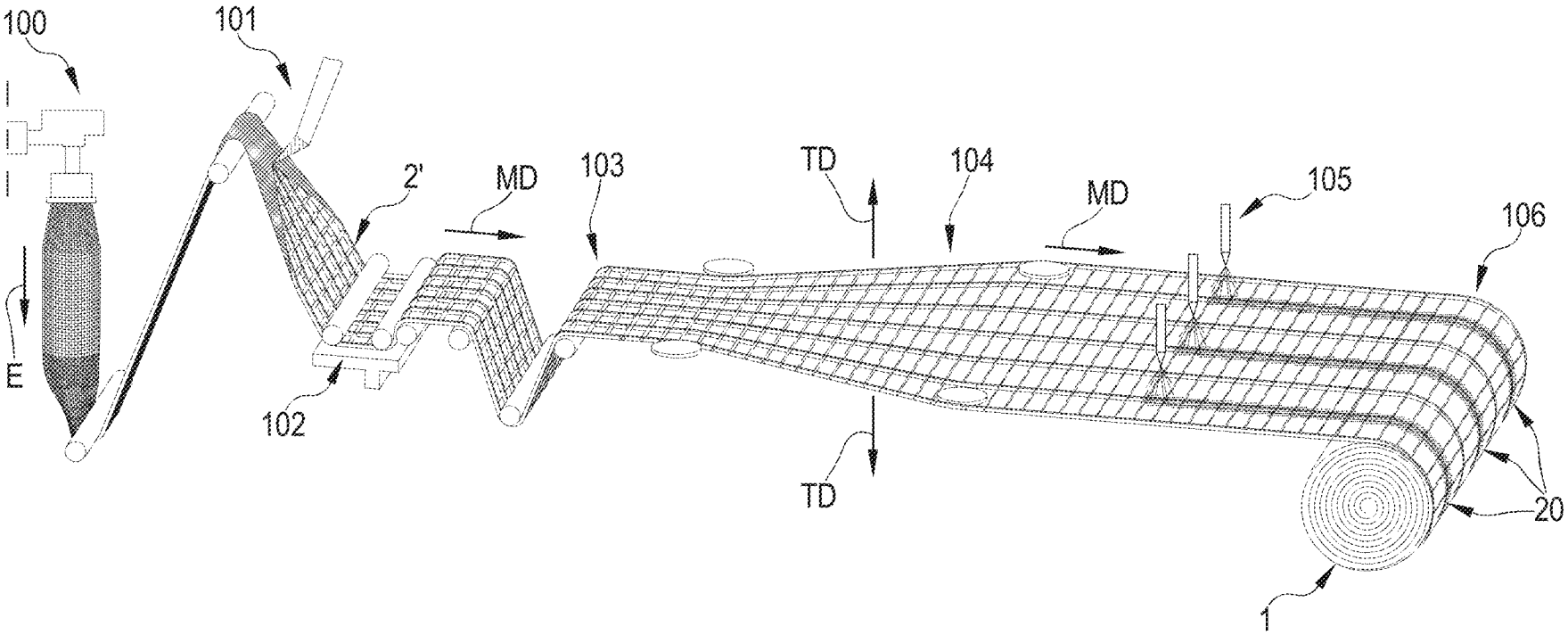
FIG. 10 is a schematic view illustrating a possible roll making process in accordance with the present invention.

The extrusion process, depicted schematically in FIG. 10, involves the simultaneous extrusion of first and second precursor bodies 3', 4' by means of an extrusion head 100; the first precursor bodies 3' are longitudinal elements that extend along an extrusion direction E (thus along an advancement direction MD of the extruded material exiting head 100) while the second precursor bodies 4' are elements transverse to the first precursor bodies 3': First and second precursor bodies 3', 4' forming a monolithic integral reticular body. The advancement direction MD is also recognized in the extrusion filed as the machine direction MD, which is the direction along which the extruded semifinished product 2' advances during its formation.

The extrusion step may be carried out at a temperature between 110° C. and 260° C., optionally between 150° C. and 220° C.; the material exiting the extrusion head move between 5 meters/minute and 12 meters/minute, optionally between 6 meters/minute and 10 meters/minute. Extrusion may be carried out with a cylindrical head suitable for forming a reticular structure having a cylindrical shape.

Subsequently, such a reticular structure exiting the extrusion head (extruder 100) is cooled to be cut longitudinally and then opened in a flat configuration. FIG. 10 shows a cutting station 101 of the cylindrical reticular structure and a subsequent opening station 102 where the reticular structure is opened in a single plane. The opened reticular structure may be defined as reticular structure 2 presenting unstretched first and second elements. Such a reticular structure, once opened, is ready to be rolled up into a roll at a collection station 106. Alternatively, subsequent to the formation of the 2' semi-finished product, the latter may undergo a stretching process.

In detail, as mentioned above, the 2' semi-finished product exiting the extrusion head has first and second precursor bodies 3', 4' spaced and interconnected to define a network. In a realizable form, the semifinished product is extruded by means of a through a head utilizing pulsating technology; the first precursor bodies 3' extend along the extrusion direction while the second precursor bodies 4' extend orthogonally to said first precursor bodies 3' to define said semifinished product 2' in the form of a net having square or rectangular meshes.

Subsequently, such a semifinished product is cooled to be cut longitudinally, that is, along the direction of development of the first precursor bodies to be then opened and stretched flat. FIG. 10 shows a cutting station 101 of the semifinished product and a subsequent opening station 102 in which said semifinished product is opened on a single plane. When opened in plane the first precursor bodies 3' define longitudinal bodies extending along the advancement direction MD while the second precursor bodies define transverse bodies placed orthogonally to the advancement direction.

Figure 11:
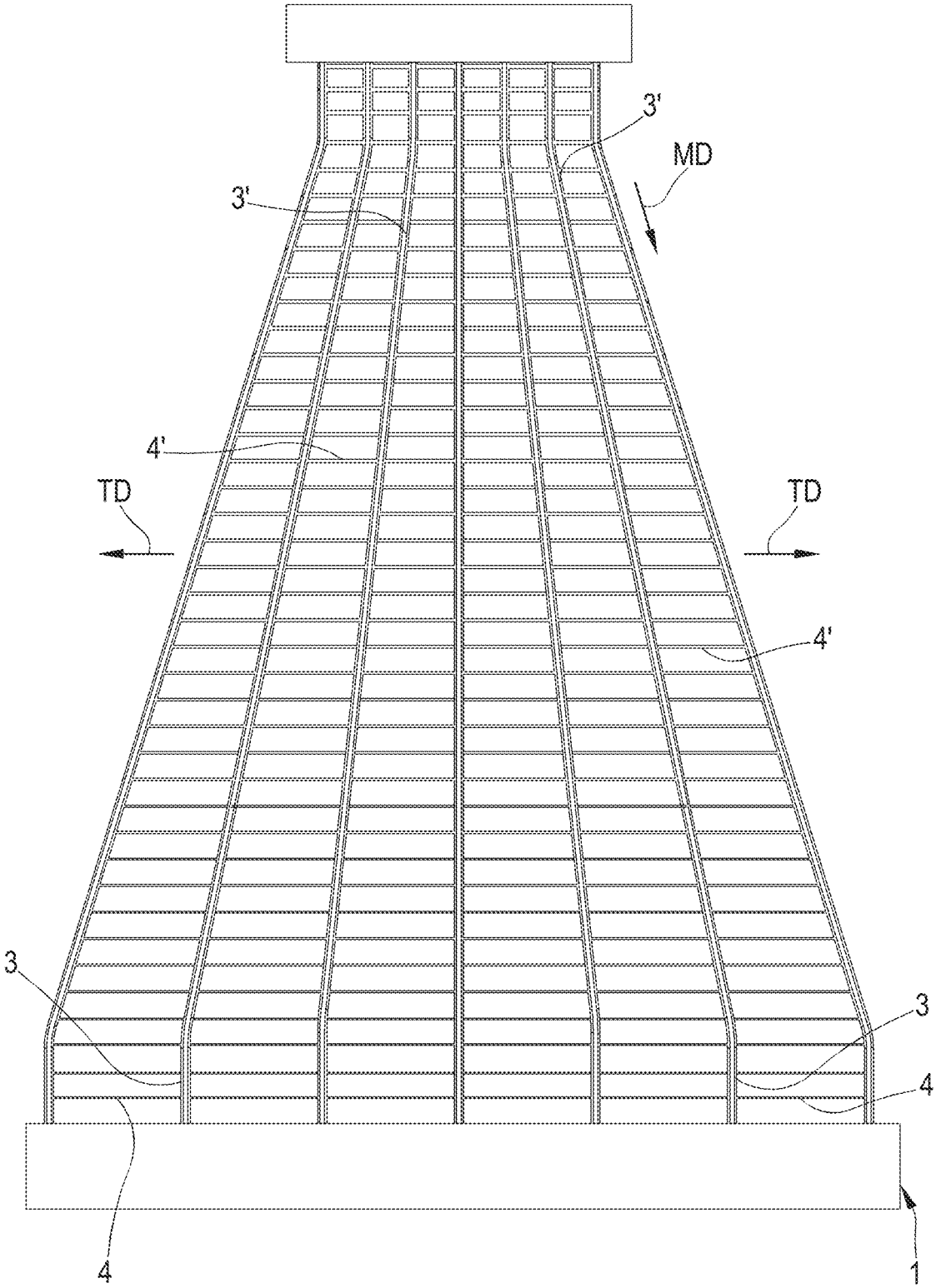
FIG. 11 is a detailed top view of the process of FIG. 10.

The 2' semi-finished product when opened may be stretched along the first and/or second precursor bodies. For example, the process may perform the stretching step of only the first precursor bodies 3' or only the second precursor bodies 4' to define a mono-stretched reticular structure 2. Alternatively, the manufacturing process may involve a double stretching action, that is, both along the development of the first precursor bodies and along the development of the second precursor bodies to define a bi-stretched (or also called bi-oriented) reticular structure 2. FIGS. 10 and 11 show a schematic of a procedure involving double stretching, i.e., stretching along the machine direction MD and stretching orthogonally to said machine direction, i.e., along a transverse direction TD.

In detail, the process may involve an initial stretching action of the first precursor bodies at a longitudinal stretching station 103 located immediately downstream of the opening station 102. The stretching of the first precursor bodies 3' to define said first stretched elements 3 may be carried out by means of moving the semi-finished product 2' along the advancement direction at a speed greater than the extrusion speed to allow for a stretching of the semi-finished product along the machine direction MD; for example, the stretching speed of the first precursor bodies—to define said first stretched elements 3—is carried out, along the advancement direction MD, at a speed between 20 meters/minute and 40 meters/minute. During the stretching step, the semi-finished product is heated to a temperature between 65° C. and 150° C. In particular, the stretching step of the first precursor bodies is optionally performed in a water bath at a temperature between 75° C. and 100° C. Of course, the possibility of stretching step of the first precursor bodies when the reticular structure semifinished product is in its circular form, is not excluded.

The process may also include a second stretching action performed on the second precursor bodies at a transverse stretching station 104 located downstream of the stretching station, particularly immediately downstream of the longitudinal stretching station 103. The stretching of the second precursor bodies to define said stretched second elements 4 may be performed by means of a pulling step, such as by grippers, of the reticular structure semifinished product according to a direction orthogonal TD to the advancement direction (i.e., the machine direction MD). The stretching speed of the second precursor bodies—to be defined as second elements 4 stretched—is carried out at a speed between 4 meters/minute and 30 meters/minute, optionally between 10 meters/minute and 100 meters/minute, optionally between 20 meters/minute and 50 meters/minute. The stretching step of the second precursor bodies is optionally performed in a case inside which heated air is present, at a temperature between 85° C. and 150° C. Of course, the possibility of performing the stretching step of the second precursor bodies before the stretching of the first precursor bodies is not excluded.

Following the formation of the reticular structure 2 and then the first and second elements 3, 4 (optionally stretched), the process involves the definition on at least a part of said reticular structure of the marker 20. Specifically, the marker 20 is applied to the reticular structure 2 on at least one between the lower and upper surface of the reticular structure 2. The marker 20 may comprise at least of a paint, an ink a magnetic element. For example, the marker 20 may be applied to the reticular structure at an application station 105 located downstream of the opening station 102, optionally downstream of the at least one stretching station (103 and/or 104), which may perform the painting of the reticular structure. For example, wherein the marker 20 comprises a paint and/or ink, the process may include a step of painting and/or spraying said ink and/or paint to define the marker on the reticular structure (FIG. 10). Then, the reticular structure 2 is wound in roll, at a collection station 106, around the winding axis X to define said roll 1. The winding axis X is orthogonal to the machine direction MD; then, once the desired amount of reticular structure 2 is reached, it is cut transversely to define said roll 1. The step of defining marker 20 on the reticular structure may be carried out on the reticular structure before and/or during the step of winding said reticular structure 2 into roll.

Laying Process

Also forming an object of the present invention is a process of laying a reticular structure 2 of roll 1 on soil S. This process is schematically illustrated, for example, in FIGS. 3 and 4.

The process involves moving the entire roll 1 along an advancement trajectory, such as by an agricultural vehicle, such as a tractor.

During the handling of the entire roll 1, the process involves unrolling the roll 1 around the winding axis X of the roll so that the unrolled reticular structure 2 is arranged on the ground S, basically according to a flat configuration.

In detail, the unwinding step of the roll 1 comprises an initial unwinding step during which the unwinding of roll 1 is initiated and the unwinding of the reticular structure of the group of end windings of roll 1 is carried out first; in fact, the first portion of roll 1 is that defined by the windings of the group of end windings. When the unwinding of roll 1 is initiated, the reticular structure that is carried out first is precisely that of the group of end windings. The unwinding step also comprises a second unwinding step, which follows said first unwinding step and during which the unwinding of the reticular structure 2 of the group of initial windings of the roll is carried out; this step is schematized in FIGS. 3 and 4.

As described above, the reticular structure 2 of the group of initial windings is the one comprising marker 20. Thus, the process may include a step of identifying the reticular structure 2 of the group of initial windings of roll 1 by identification of marker 20. Identification of marker 20 provides the user with information regarding the amount of roll remaining to be laid. In fact, as described above, marker 20 is present only on the windings of the group of initial windings, i.e., on a reduced portion of windings arranged either at the winding axis X or at the longitudinal seat 15. When the user identifies marker 20, he receives information that the roll is about to end and that a possible roll 1 change will therefore have to be made shortly.

The marker 20 identification step may involve identifying the marker 20 present on the reticular structure of the group of initial windings and/or identifying the marker 20 present on the unwounded reticular structure.

This identification step may be substantially nonautomated and be carried out directly by the user. In fact, it may be the user himself who, by observing the unrolling of the reticular structure, identifies marker 20 and thus receives information about the state of the roll, specifically the amount of reticular structure still available.

Of course, the possibility of performing this identification operation automatically is not excluded, for example, by taking advantage of one or more sensors connected to at least one control unit, which is active in command on at least one marker 70. In particular, the identification step of marker 20 may involve the following sub steps:

The generation of a signal by a sensor, wherein said signal is representative of a control parameter, sending said signal to a control unit configured to receive and process said signal.

The sensor may comprise at least one of: a camera, a magnetic sensor, electrical resistance sensor, an electrical current sensor, an electrical voltage sensor, an encoder, a distance sensor. The signal emitted by said sensor is representative of the control parameter, which may comprise information related to at least one of: the presence of the marker 20 on the reticular structure of the group of initial windings, the presence of the marker 20 present on the unwound reticular structure.

The control unit may then be configured to receive said signal to identify marker 20 on reticular structure 2 of the group of initial windings and/or identify marker 20 present on the unwound reticular structure. Once the marker 20 has been identified, the control unit may be configured to command the signaling device 70 to issue an alarm to inform the user that the reticular structure of the group of initial windings has been unwound. For example, the visual signaling device (e.g., a display, a light), an audible signaling device (e.g., a siren).

For example, the sensor may comprise a camera suitable for sending a signal to the control unit; the control unit may be configured to process the signal received from the sensor, and wherein the control unit detects the presence of the marker, the control unit may command the emission of an alarm to provide the user with an indication of the amount of reticular structure 2 remaining on the roll. In an equal manner, the sensor may comprise a magnetic sensor configured to emit a signal only when the presence of the marker 20 is detected, for example comprising a magnetic strip.

As a further variant, the process may involve the use of a camera pointed at roll 1 and connected to a display located near the user's location; in this way, the user may directly detect the status of roll 1, merely by observing the display (see, for example, FIG. 4). Once the marker is detected, the process may involve replacing roll 1 with a new roll.

Process of Making a Turf Course

It also forms an object of the present invention to provide a process for making a turf sod 1 comprising a reticular structure 2 of roll 1 as described above and/or in accordance with any one of the united claims.

The process may comprise the step of laying the reticular structure on soil S by the laying process described above. In detail, the reticular structure in roll form is unrolled and then laid on the soil portion. The reticular structure 2 may then be laid above (in support of) the exposed surface of the soil, or it may be flattened on the soil such that at least part of said reticular structure 2 may submerge into the soil, while still remaining in close proximity to the exposed surface. Following the laying (spreading) of the reticular structure 2, the process comprises a soil seeding stage by laying grass seed. Following seeding, the grass follows the normal growth process, which may last, for example depending on soil conditions and treatments, from 6 months to 14 months. During the grass growth step, the reticular structure is configured to incorporate itself within the soil layer and to the grass to allow soil consolidation. Following the growth of grass on the portion of the soil, the process involves a cutting step in the soil to delineate a turf or sod of grass. The turf thus cut is then harvested to be laid on top of soil for turf establishment. See FIG. 9.

Grass Roll

It also forms an object of the present invention to have a grass roll R comprising a reticular structure 2 of roll 1 in accordance with the foregoing and/or in accordance with any one of the united claims.

The grass roll R is wrapped around an axis in a spiral pattern (see, for example, FIG. 9) and comprises a soil layer S, a predetermined amount of grass G emerging from one side of the soil layer, and at least one reticular structure 2 engaged to the soil layer. The reticular structure 2 is configured, in use, to consolidate at least the soil layer S; the soil layer S extends in thickness between a first and a second surface, optionally the thickness of the soil layer is greater than 0.5 cm, optionally it is between 0.65 cm and 2.5 cm. The roll of grass R, fully unrolled and arranged in a plane, has a length between 1 meter and 40 meters; said length being measured along a direction of unrolling of the same roll of grass R. The roll R has a width equal to or greater than 0.6 meters, optionally between 0.6 meters and 2 meters; said width being measured along the axis around which said roll of grass is wound.

Process of Making a Grass Roll

Also forming an object of the present invention is a process for making a grass roll comprising a reticular structure 2 of roll 1 as described above and/or in accordance with any one of the attached claims.

Figure 9:
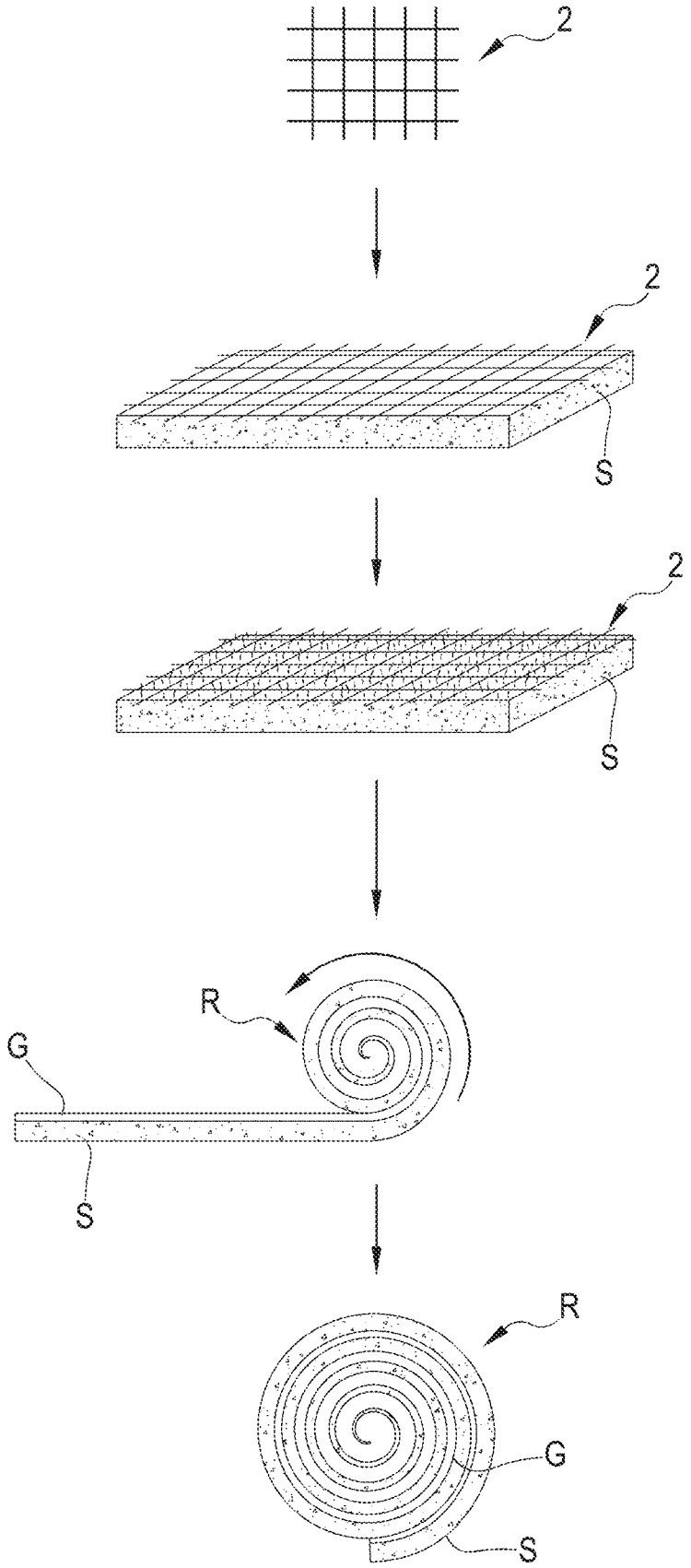
FIG. 9 is a schematic representation of a process of making a grass roll using a reticular structure.

The process of making the roll is schematically illustrated in FIG. 9. This process comprises the same steps for laying reticular structure 2 of roll 1 and seeding as described above for turf establishment. Following the growth of grass on the portion of the plot, the process includes a cutting step in the soil for delineating the turf to define an elongated zone along a direction of development. The turf thus cut is then collected by means of a rolling action (see, for example, FIG. 9) around an axis orthogonal to the direction of development to define said turf roll R. The turf roll R thus created is then ready to be unrolled on a plot of land for turf establishment.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the disclosure states otherwise. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A roll configured for soil consolidation or stabilization, the roll comprising a monolithic reticular structure of plastic material, wherein the monolithic reticular structure includes:

a plurality of first elements spaced from each other and having an elongated conformation according to a first trajectory, and a plurality of second elements spaced from each other and having an elongated conformation according to a second trajectory transverse to the first trajectory, wherein said plurality of first elements and second elements intersect at nodes to form meshes, wherein the monolithic reticular structure is wrapped around a winding axis to define a plurality of windings, wherein said plurality of windings comprises:

a group of initial windings defined between an initial inner winding of the monolithic reticular structure and an intermediate winding, and a group of end windings defined between a final outer winding of the monolithic reticular structure and said intermediate winding, wherein the roll comprises at least one marker arranged on the group of initial windings or the group of end windings of the monolithic reticular structure, and wherein the at least one marker is configured to visually differentiate the monolithic reticular structure of the group of initial windings from the monolithic reticular structure of the group of end windings, wherein the at least one marker comprises a painted strip on a top or bottom surface of the monolithic reticular structure, and wherein the roll is configured for soil consolidation or soil stabilization.

2. The roll according to claim 1, wherein the at least one marker is arranged only on the group of initial windings of the monolithic reticular structure.

3. The roll according to claim 1, wherein the group of initial windings has a predetermined number of windings, wherein a ratio of the predetermined number of windings of the group of initial windings to the total number of windings of the monolithic reticular structure is no greater than 0.2.

4. The roll according to claim 1, wherein all of the windings of the group of initial windings of the monolithic reticular structure comprise said at least one marker.

5. The roll according to claim 1, wherein the monolithic reticular structure has a total length measured along said windings of at least 2000 meters.

6. The roll according to claim 1, wherein the monolithic reticular structure defining the group of initial windings has a predetermined length measured along said windings, wherein a ratio of the predetermined length of the monolithic reticular structure defining the group of initial windings to a total length of the monolithic reticular structure is no greater than 0.1.

7. The roll according to claim 1, wherein the at least one marker is applied only on part of the monolithic reticular structure of the group of initial windings.

8. The roll according to claim 1, wherein the at least one marker extends throughout a longitudinal extension of the monolithic reticular structure defining the group of initial windings.

9. The roll according to claim 1, wherein the at least one marker extends from the initial inner winding to the intermediate winding.

10. The roll according to claim 1, wherein the plurality of first elements extend along the plurality of windings of the monolithic reticular structure, wherein each first element of the plurality of first elements extends in length along the total length extension of the monolithic reticular structure, wherein the second trajectory of each second element is substantially straight and parallel to the winding axis.

11. The roll according to claim 1, wherein a ratio between the distance between two adjacent first elements of the plurality of first elements, and the distance between two adjacent second elements of the plurality of second elements is in a range of 0.5 to 2.

12. The roll according to claim 1, wherein the meshes have a quadrilateral shape, wherein the size of each mesh is defined by the distance between two immediately consecutive first elements of the plurality of first elements, and the distance between two immediately consecutive second of the plurality of second elements elements which intersect at said two immediately consecutive first elements of the plurality of first elements.

13. A roll configured for soil consolidation or stabilization, the roll comprising a monolithic reticular structure of plastic material, wherein the monolithic reticular structure includes:

a plurality of first elements spaced from each other and having an elongated conformation according to a first trajectory, a plurality of second elements spaced from each other and having an elongated conformation according to a second trajectory transverse to the first trajectory, wherein said first and second elements intersect at nodes to form meshes, wherein the monolithic reticular structure is wrapped around a winding axis to define a plurality of windings, wherein said plurality of windings comprises:

a group of initial windings defined between an initial inner winding of the monolithic reticular structure and an intermediate winding, and a group of end windings defined between a final outer winding of the monolithic reticular structure and said intermediate winding, wherein the roll comprises at least one marker that extends at least partially between the initial inner winding and the intermediate winding, or between the final outer winding and the intermediate winding, wherein the at least one marker comprises a magnetic element configured to differentiate the monolithic reticular structure of the group of initial windings from the monolithic reticular structure of the group of end windings, and wherein the roll is configured for soil consolidation or soil stabilization.

14. The roll according to claim 13, wherein the at least one marker is arranged only on the group of initial windings.

15. The roll according to claim 13, wherein the at least one marker extends only across the longitudinal extension of the monolithic reticular structure defining the group of initial windings, between the initial inner winding and the intermediate winding.

16. The roll according to claim 13, wherein the group of initial windings has a predetermined number of windings, wherein a ratio of the predetermined number of windings of the group of initial windings to the total number of windings of the monolithic reticular structure is no greater than 0.2.

17. The roll according to claim 13, wherein the monolithic reticular structure has a total length measured along said windings of no less than 2,000 meters, and wherein the monolithic reticular structure defining the group of initial windings has a predetermined length measured along said windings, wherein a ratio between the predetermined length of the monolithic reticular structure defining the group of initial windings to the total length of the monolithic reticular structure is in a range of 0.05 to 0.001.

18. A roll configured for soil consolidation or stabilization, the roll comprising a monolithic reticular structure of plastic material, wherein the monolithic reticular structure includes:

first elements having an elongated conformation according to a first trajectory and spaced apart by a distance between two immediately consecutive first elements of the first elements in a range of 15 mm to 70 mm, and second elements having an elongated conformation according to a second trajectory transverse to the first trajectory and spaced apart by a distance between two immediately consecutive second elements of the second elements in a range of 15 mm to 70 mm, wherein the first elements intersect with the second elements at nodes to form a mesh, wherein the monolithic reticular structure is wrapped around a winding axis to define windings which include:

a group of initial windings defined between an initial inner winding of the monolithic reticular structure and an intermediate winding, and a group of end windings defined between a final outer winding of the monolithic reticular structure and said intermediate winding, wherein the roll comprises a marker arranged on the group of initial windings or the group of end windings of the monolithic reticular structure, wherein the marker visually differentiates the monolithic reticular structure of the group of initial windings from the monolithic reticular structure of the group of end windings, wherein the marker is applied only to the nodes, and wherein the roll is configured for soil consolidation or soil stabilization.

19. A roll configured for soil consolidation or stabilization, the roll comprising a monolithic reticular structure of plastic material, wherein the monolithic reticular structure includes:

first elements spaced from each other and having an elongated conformation according to a first trajectory, and second elements spaced from each other and having an elongated conformation according to a second trajectory transverse to the first trajectory, wherein the first elements the second elements intersect at nodes to form meshes, wherein the monolithic reticular structure is wrapped around a winding axis to define windings which include:

a group of initial windings defined between an initial inner winding of the monolithic reticular structure and an intermediate winding, and a group of end windings defined between a final outer winding of the monolithic reticular structure and said intermediate winding, wherein the roll comprises a marker arranged on the group of initial windings or the group of end windings of the monolithic reticular structure, wherein the marker visually differentiates the monolithic reticular structure of the group of initial windings from the monolithic reticular structure of the group of end windings, the wherein monolithic reticular structure and the marker are a single piece structure formed by extrusion, and wherein the roll is configured for soil consolidation or soil stabilization.

* * * * *